US006986619B2

(12) United States Patent
Hall et al.

(10) Patent No.: US 6,986,619 B2
(45) Date of Patent: Jan. 17, 2006

(54) METHOD OF CLEANING A SURFACE

(75) Inventors: Michael J. Hall, South San Francisco, CA (US); James E. Rader, Pleasanton, CA (US); Boli Zhou, Tualatin, OR (US); Karen S. Hefter, San Ramon, CA (US); David J. Sayler, Portland, OR (US); Eric Y. Park, Portland, OR (US); Robert W. Flagler, Pleasanton, CA (US); Scott T. Haubrich, San Leandro, CA (US); Shumanta Mitra, Dublin, CA (US); Richard Porticos, Los Altos, CA (US); Douglas J. Minkler, Pleasanton, CA (US); Sharon Olsen, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 10/859,019

(22) Filed: Jun. 2, 2004

(65) Prior Publication Data

US 2004/0216771 A1 Nov. 4, 2004

Related U.S. Application Data

(60) Continuation of application No. 10/350,803, filed on Jan. 24, 2003, which is a division of application No. 09/689,433, filed on Oct. 11, 2000, now Pat. No. 6,540,424.

(60) Provisional application No. 60/317,911, filed on Sep. 6, 2001, provisional application No. 60/192,040, filed on Mar. 24, 2000.

(51) Int. Cl.
*A46B 11/00* (2006.01)

(52) U.S. Cl. ..... 401/140; 401/138

(58) Field of Classification Search ..... 401/136–140
See application file for complete search history.

(56) References Cited

U.S. PATENT DOCUMENTS

| | | | |
|---|---|---|---|
| 418,959 | A | 1/1890 | Pilson |
| 595,761 | A | 12/1897 | Brockmann |
| 1,091,888 | A | 3/1914 | Lorzing |
| 1,310,290 | A | 7/1919 | Piechowics |
| D92,532 | S | 6/1934 | Graham |

(Continued)

FOREIGN PATENT DOCUMENTS

DE 3940123 A1 * 6/1990

OTHER PUBLICATIONS

Webester's Third New international Dictionary, 1976 by G. & C. Merriam Co., pp. 2208-2209 and 2258-2259.

(Continued)

*Primary Examiner*—Justine R. Yu
*Assistant Examiner*—Huyen Le
(74) *Attorney, Agent, or Firm*—Michael J. Mazza, Esq.; Monica H. Winghart, Esq.; Ray K. Shahani, Esq.

(57) ABSTRACT

A method for cleaning a surface using a tool with both a cleaning head and a cleaning fluid reservoir housing coupled to an elongated handle, the method comprising the following steps: attaching a cleaning pad to the cleaning head; inserting a replaceable cleaning fluid reservoir into the housing; fluidically coupling the cleaning fluid reservoir to the cleaning head; dispensing controlled amounts of cleaning fluid from the reservoir onto a surface; and distributing the cleaning fluid evenly over the surface with the cleaning pad.

1 Claim, 26 Drawing Sheets

U.S. PATENT DOCUMENTS

| | | | |
|---|---|---|---|
| D95,904 | S | 6/1935 | Fuerst |
| D102,368 | S | 12/1936 | Higgins |
| 2,137,944 | A | 11/1938 | MacLeod |
| 2,238,360 | A | 4/1941 | Forster |
| 2,470,837 | A | 5/1949 | Polson |
| 2,664,278 | A | 12/1953 | Aghnides |
| 2,698,954 | A | 1/1955 | Muirheid |
| D178,876 | S | 10/1956 | Glaberson |
| 2,764,774 | A | 10/1956 | Belsky et al. |
| 2,782,919 | A | 3/1957 | Ansell |
| D190,626 | S | 6/1961 | Musichuk |
| 3,016,556 | A | 1/1962 | Greenleaf |
| 3,055,031 | A | 9/1962 | Rachlin |
| 3,126,573 | A | 3/1964 | Vosbikian et al. |
| D200,364 | S | 2/1965 | Brody |
| D201,791 | S | 8/1965 | Hershberger et al. |
| 3,221,996 | A | 12/1965 | Emmert et al. |
| D206,913 | S | 2/1967 | Hills |
| 3,377,123 | A | 4/1968 | Leeson |
| 3,457,016 | A | 7/1969 | Gotberg |
| 3,784,311 | A | 1/1974 | Failing |
| 3,932,043 | A | 1/1976 | Joffre |
| 4,059,358 | A | 11/1977 | Arai |
| 4,065,536 | A | 12/1977 | Lucas |
| 4,069,066 | A | 1/1978 | Hindle et al. |
| 4,119,386 | A | 10/1978 | Cushing |
| D257,504 | S | 11/1980 | Weckman |
| 4,480,793 | A | 11/1984 | Grande |
| 4,603,450 | A | 8/1986 | Osberghaus et al. |
| 4,606,958 | A | 8/1986 | Haq et al. |
| 4,680,826 | A | 7/1987 | Schunter |
| 4,714,200 | A | 12/1987 | Sayama |
| 4,778,298 | A | 10/1988 | Shin et al. |
| 4,802,782 | A | 2/1989 | Scalf |
| 4,843,674 | A | 7/1989 | Jones |
| 4,863,299 | A | 9/1989 | Osberghaus et al. |
| D306,924 | S | 3/1990 | Shapton |
| 4,927,283 | A | 5/1990 | Fitjer |
| 4,936,510 | A | 6/1990 | Weinstein |
| 4,955,748 | A | 9/1990 | Krumholz |
| 4,983,060 | A | 1/1991 | Steinbach |
| 4,987,632 | A | 1/1991 | Rowe et al. |
| 4,991,250 | A | 2/1991 | Young |
| 4,995,133 | A | 2/1991 | Newell |
| 5,071,489 | A | 12/1991 | Silvenis et al. |
| 5,094,559 | A | 3/1992 | Rivera et al. |
| 5,115,538 | A | 5/1992 | Cochran et al. |
| 5,141,348 | A | 8/1992 | 'tartt |
| 5,195,999 | A | 3/1993 | Harada et al. |
| D338,090 | S | 8/1993 | Kamiyama |
| 5,253,387 | A | 10/1993 | Kresse et al. |
| D354,683 | S | 1/1995 | Rupert |
| 5,390,390 | A | 2/1995 | Kresse et al. |
| 5,419,015 | A | 5/1995 | Gracia |
| 5,461,749 | A | 10/1995 | Ahlberg et al. |
| D364,014 | S | 11/1995 | Langeland et al. |
| D364,948 | S | 12/1995 | Hunt |
| D372,570 | S | 8/1996 | Dokos |
| 5,603,139 | A | 2/1997 | Alazet |
| 5,609,255 | A | 3/1997 | Nichols |
| D380,359 | S | 7/1997 | Meisner et al. |
| 5,735,620 | A | 4/1998 | Ford |
| D394,607 | S | 5/1998 | Monaghan et al. |
| 5,769,324 | A | 6/1998 | Leonhart |
| 5,779,155 | A | 7/1998 | Schennum et al. |
| 5,784,755 | A | 7/1998 | Karr et al. |
| D396,908 | S | 8/1998 | Beechuk et al. |
| D398,099 | S | 9/1998 | Leung |
| D401,703 | S | 11/1998 | Beechuk et al. |
| 5,842,504 | A | 12/1998 | Schennum et al. |
| 5,842,682 | A | 12/1998 | Schennum et al. |
| 5,849,805 | A | 12/1998 | Dyer |
| 5,858,515 | A | 1/1999 | Stokes et al. |
| 5,865,551 | A | 2/1999 | Lalli et al. |
| 5,888,006 | A | 3/1999 | Ping et al. |
| 5,908,255 | A | 6/1999 | Branch |
| 5,953,784 | A | 9/1999 | Suzuki et al. |
| 5,960,508 | A | 10/1999 | Holt et al. |
| 5,962,112 | A | 10/1999 | Haynes et al. |
| 5,988,920 | A | 11/1999 | Kunkler et al. |
| 6,000,088 | A | 12/1999 | Wright et al. |
| 6,003,191 | A | 12/1999 | Sherry et al. |
| 6,045,622 | A | 4/2000 | Holt et al. |
| 6,048,123 | A | 4/2000 | Holt et al. |
| 6,052,856 | A | 4/2000 | DeMoya et al. |
| D425,274 | S | 5/2000 | Kunkler |
| D428,677 | S | 7/2000 | Saunders et al. |
| 6,101,661 | A | 8/2000 | Policicchio et al. |
| 6,165,160 | A | 12/2000 | Suzuki et al. |
| D443,121 | S | 5/2001 | Hamm et al. |
| 6,305,046 | B1 | 10/2001 | Kingry et al. |
| 6,316,687 | B1 | 11/2001 | Davis et al. |
| 6,319,593 | B1 | 11/2001 | Kenmochi et al. |
| 6,369,291 | B1 | 4/2002 | Uchimoto et al. |
| D462,150 | S | 8/2002 | Rader et al. |
| 6,474,986 | B2 | 11/2002 | Oda et al. |

OTHER PUBLICATIONS

Chemical Engineers' Handbook, 1973 by Robert H. perry and Cecil H. Chilton pp. 5-4, 18-58 and 18-59.
U.S. Appl. No. 10/233,773 filed Aug. 30, 2002.
U.S. Appl. No. 10/234,959 filed Aug. 30, 2002.
U.S. Appl. No. 10/233,774 filed Aug. 30, 2002.
U.S. Appl. No. 10/351,293 filed Jan. 24, 2003.
U.S. Appl. No. 10/350,804 filed Jan. 24, 2003.

* cited by examiner

501

METHOD OF CLEANING A SURFACE

RELATED INVENTIONS

This Application is a Continuation of U.S. patent application Ser. No. 10/350,803 filed Jan. 24, 2003 entitled METHOD OF CLEANING A SURFACE, which is a Divisional of related pending U.S. patent application Ser. No. 09/689,433 filed Oct. 11, 2000 entitled ADVANCED CLEANING SYSTEM, now U.S. Pat. No. 6,540,424 which is incorporated herein by reference in its entirety, and claims any and all benefits to which it is entitled therefrom. This application is also related to and incorporates by reference, in its entirety, U.S. Provisional Patent Applications Ser. Nos. 60/192,040 and 60/317,911 filed Mar. 24, 2000 and Sep. 6, 2001, respectively, and claims any and all benefits to which it is entitled therefrom.

BACKGROUND OF THE INVENTION

Cleaning devices and systems for use in the home, industrially or otherwise include a broad range of technology. With regard to hand-held, mop-like devices used by an individual, the prior art is replete with variations. Conventional floor, ceiling, wall or other surface mops typically have a rigid, elongated handle portion, the handle having a proximal and a distal end. The handle portion is held closer to the proximal end, while a cleaning head is placed at the distal end of the handle. Typically, mop heads for use indoors are about 3–4 inches wide and about 9–12 inches long, and they typically have a removable sponge or other type absorbent pad portion. As is well know, once a cleaning pad becomes worn out or soiled beyond utility, it is removed and replaced with a fresh cleaning pad.

Typically, a mop head is dipped into a pail or bucket containing water and a cleaning agent. The mop head is wrung out so as not to deposit too great an amount of cleaning fluid on the surface being cleaned. It would be highly useful to provide a hand-held mopping system with an on-board, disposable, rechargeable or replaceable fluid reservoir.

U.S. Pat. No. 5,071,489 issued Dec. 10, 1991 to Silvenis et al. teaches a floor cleaner using disposable sheets. The apparatus comprises a handle portion pivotally attached to a cleaning head member with a flat lower surface. The lower surface of the member has frictional means thereon which are intended to maintain a pre-moistened fabric sheet between the surface and an area to be cleaned. The frictional means are a series of raised portions, etc.

U.S. Pat. No. 5,609,255 issued Mar. 11, 1997 to Nichols teaches a washable scrubbing mop head and kit. The device and system contains a multi-part handle, head portion, and an attachable sponge mop pad.

U.S. Pat. No. 5,888,006 issued Mar. 30, 1999 to Ping et al. teaches a cleaning implement having a sprayer nozzle attached to a cleaning head member. Cleaning fluid sprays out of a sprayer nozzle portion attached to a cleaning head mounted at the base of a handle portion, the head portion mounted to the handle portion with a universal joint.

U.S. Pat. No. 5,953,784 issued Sep. 21, 1000 to Suzuki et al. teachers a cleaning cloth and cleaning apparatus. The apparatus includes a handle with a front, flat head section for insertion into a bag-like cleaning cloth.

U.S. Pat. No. 5,988,920 issued Nov. 23, 1999 to Kunkler et al. teaches a cleaning implement having a protected pathway for a fluid transfer tube. The cleaning implement has a fluid reservoir coupled to a dispenser with a universal joint, and a fluid transfer tube, the fluid transfer tube at least partially positioned to pass through the universal joint.

Pat. No. 5,960,508 issued Oct. 5, 1999 to Holt et al. teaches a cleaning implement having controlled fluid absorbency. U.S. Pat. No. 6,003,191 issued Dec. 21, 1999 to Sherry et al. teaches a cleaning implement. U.S. Pat. No. 6,048,123 issued Apr. 11, 2000 to Holt et teaches a cleaning implement having high absorbent capacity. Overall maximum fluid absorbencies, rates of absorbency, and squeeze-out rates are defined, and examples of materials which exhibit those types of behavior are provided. As best understood, these inventions are directed to the use of superabsorbent materials, and not the use of conventional, natural and synthetic materials.

A microfiber is atypically, and others are included herein as well, made of a polyester/polyamide blend that has a thickness finer than 1/100 of a human hair. In the industry of fibers and fabrics, the following classifications of fibers is considered standard:

| Yarn Count | Fiber Classification |
|---|---|
| >7.0 dpf* | coarse fiber |
| 2.4–7.0 dpf | normal fiber |
| 1.0–2.4 dpf | fine |
| 0.3–1.0 dpf | microfiber |
| <0.3 dpf | ultra-microfiber |

*dpf = denier per filament
Note:
A filament with a thickness of 1 denier corresponds to a yarn length of 9,000 meters/gram. Thus, a 0.2 denier fiber corresponds to a yarn length of 45 kilometers/gram

SUMMARY AND ADVANTAGES

The present invention is an advanced cleaning system comprising a handle portion, the handle portion having a proximal end and a distal end; a cleaning head portion, the cleaning head portion adapted for use with a removable cleaning pad; and a cleaning fluid reservoir fluidically coupled to the cleaning head portion such that cleaning fluid is controllably allowed to flow via gravity onto the surface to be cleaned adjacent the cleaning head portion. The cleaning system further comprises a nozzle portion mounted to the head portion. The cleaning system flow of cleaning fluid is a trickle. The head portion of the cleaning system is coupled to the handle portion with a yoke means. The cleaning system further comprises a cleaning pad.

In a preferred embodiment, the advanced cleaning system comprising: a handle portion, the handle portion having a proximal end and a distal end; and a cleaning head portion, the cleaning head portion adapted for use with a removable cleaning pad, the cleaning head portion having an essentially convex lower surface.

The present invention is a cleaning system comprising: a handle portion, the handle portion having a proximal end and a distal end; a cleaning head portion, the cleaning head portion adapted for use with a removable cleaning pad; and a cleaning fluid reservoir, the fluid reservoir fluidically coupled to the cleaning head portion; and means for controllably dispensing cleaning fluid from the fluid reservoir onto the surface to be cleaned adjacent the cleaning head portion.

The present invention is a cleaning system comprising: a handle portion, the handle portion having a proximal end and a distal end; a cleaning head portion, the cleaning head portion adapted for use with a removable cleaning pad; and means for removably coupling a cleaning fluid reservoir to the system for dispensing cleaning fluid adjacent the cleaning head portion.

The present invention is a kit for a cleaning system comprising: an handle portion, the handle portion having a proximal end and a distal end; a cleaning head portion; one or more removable cleaning pads; and means for removably coupling a cleaning fluid reservoir to the system for dispensing cleaning fluid adjacent the cleaning head portion.

The present invention is a method for applying a fluid to a surface with a tool comprising a handle portion, a head portion, and a fluid reservoir attached thereto, the method comprising the following steps: obtaining the handle portion; mechanically coupling a fluid reservoir to a handle portion and fluidically coupling the fluid reservoir to the head portion; controllably dispensing the fluid onto the surface; and distributing the fluid dispensed onto the surface with the head portion.

The present invention is a cleaning system including: one or more shaft sections of a handle sub-assembly; a holster sub-assembly which mounts on the handle sub-assembly; a yoke section located at a distal end of the one or more shaft sections of a handle sub-assembly; a head sub-assembly coupled to the one or more shaft sections of the handle sub-assembly adjacent the yoke section; and a cleaning fluid reservoir having a fluid delivery tube and a nozzle assembly, the nozzle assembly being mountable onto the head sub-assembly.

DETAILED DESCRIPTION OF THE PREFERRED EMBODIMENT

Figure 1:
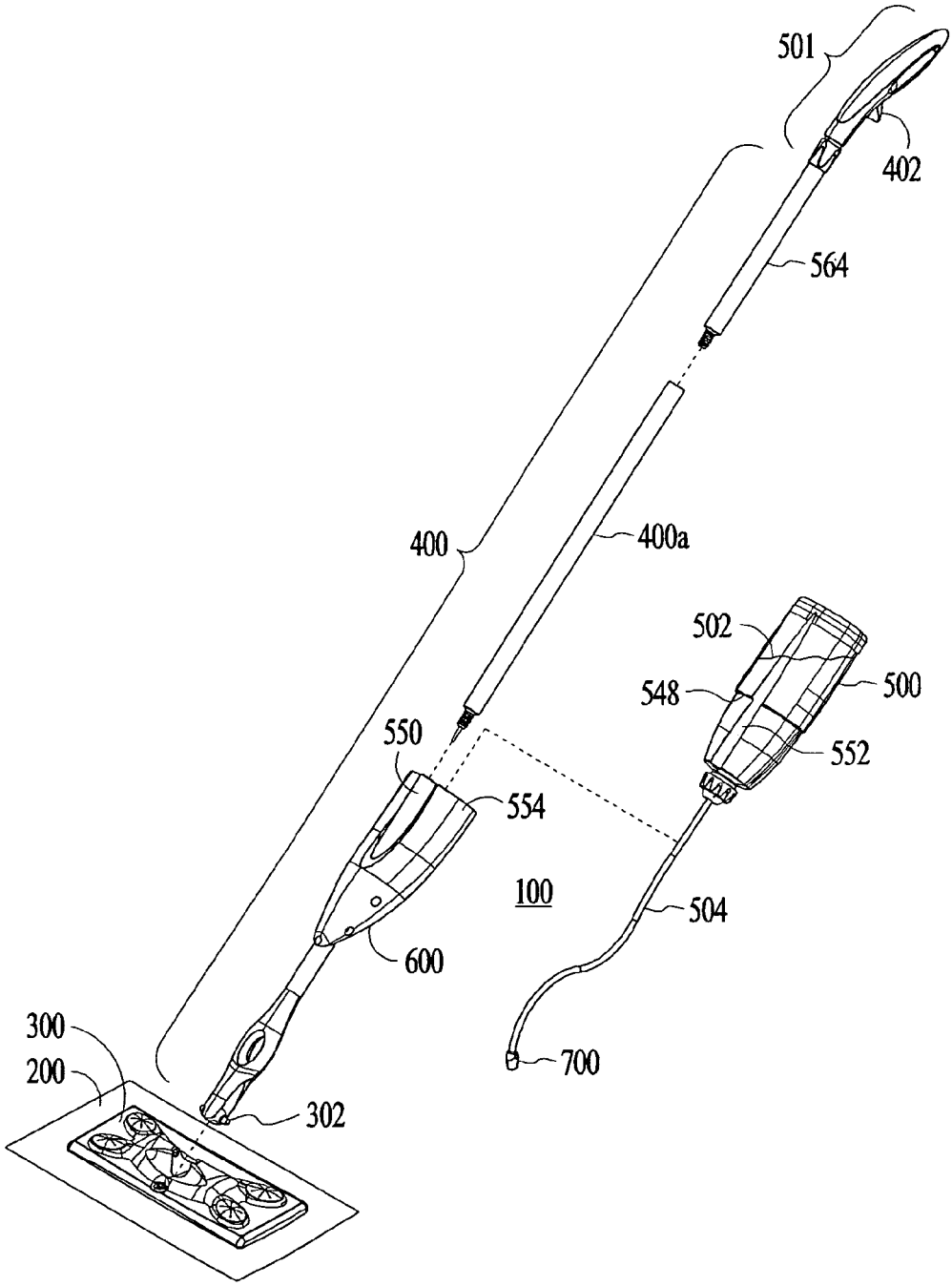
FIG. 1 is a representative exploded view of a preferred embodiment of a cleaning system 100 of the present invention.

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

It will be understood that in the event parts of different embodiments have similar functions or uses, they may have been given similar or identical reference numerals and descriptions. It will be understood that such duplication of reference numerals is intended solely for efficiency and ease of understanding the present invention, and are not to be construed as limiting in any way, or as implying that the various embodiments themselves are identical.

Figure 2:
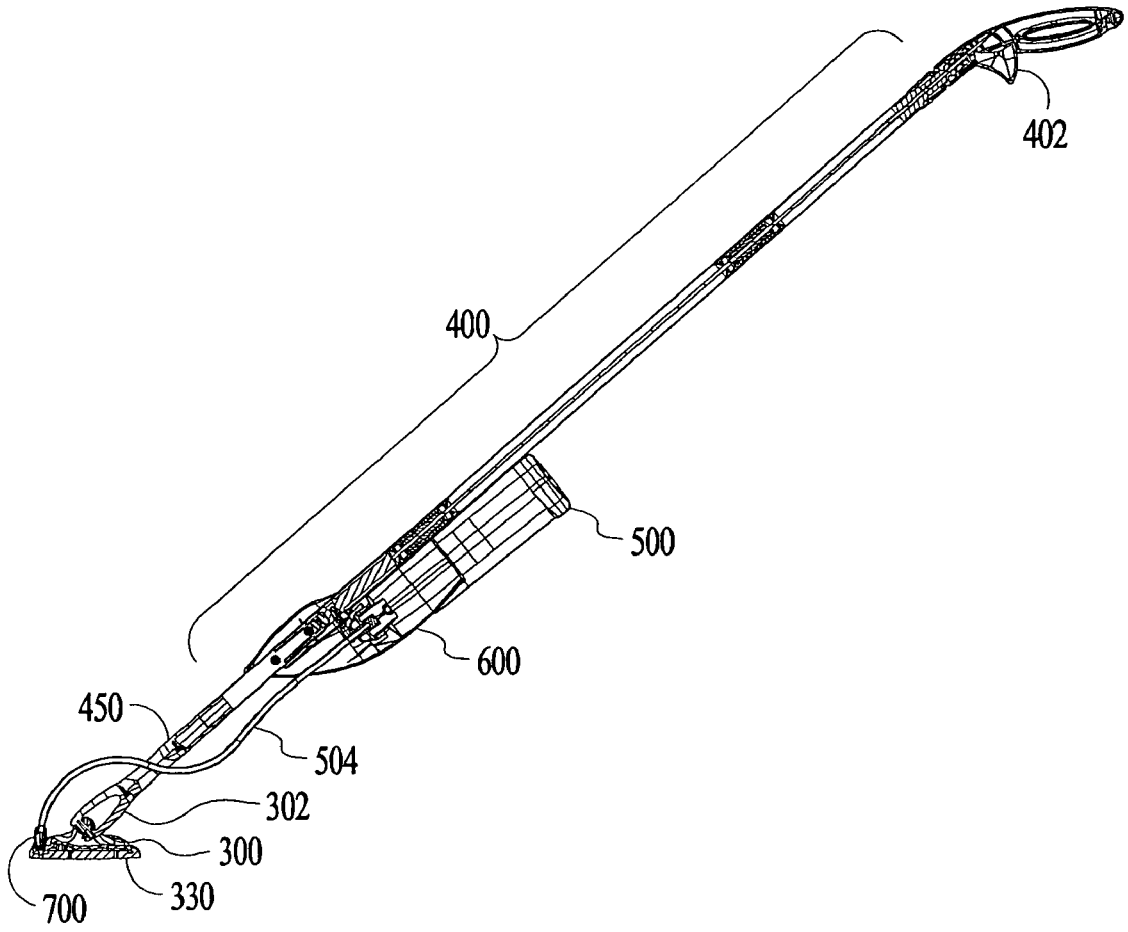
FIG. 2 is a representative cross section view of a preferred embodiment of a cleaning system 100 of the present invention.

FIG. 1 is a representative exploded view of a preferred embodiment of a cleaning system 100 of the present invention. FIG. 2 is a representative cross section view of a preferred embodiment of a cleaning system 100 of the present invention. The cleaning tool 100 consists of a preferred embodiment of an absorbent cleaning pad or sheet 200 which is removably mounted onto a cleaning head assembly 300. The head sub-assembly 300 is attached via universal joint 302 to a handle sub-assembly 400. The handle sub-assembly 400 can be disassembled for easy storage. A fluid reservoir 500 which is intended to carry a liquid cleaning solution 502 can be mounted on the handle sub-assembly 400 within a suitably designed holster sub-assembly 600. The fluid reservoir 500 has a flow delivery tube 504 which leads through a yoke portion on the handle sub-assembly to an fluid nozzle sub-assembly 700 which is mounted on the cleaning head sub-assembly 300 near the leading edge of the absorbent pad or sheet 200. A trigger mechanism 402 located on the proximal end of the handle sub-assembly 400 actuates a valve system for providing flow of fluid from the fluid reservoir 500 through the nozzle sub-assembly 700.

It will be understood that the mechanical linkages described herein between the shaft sections of the handle portion 400 can all be configured to be collapsible, disassemblable, telescoping, bayonet mounted and linked, etc. Such adaptability for the system is designed to enhance storage, packaging, and utility of the system 100 of the present invention.

In a preferred embodiment, the handle portion 400 comprises sections which interlock together in a bayonet-type configuration. The sections are each distinctively keyed, sized or shaped to confirm that the advanced cleaning system 100 is assembled properly. In a preferred embodiment, the system is a one-time assembly system, and is basically a no-disassembly system. The shaft section 400*a* and others, can be single assembly, over-torque-proof design, such as incorporating advanced, flanged or cone-shaped collars and keyed end sections, are also important and will be included within the present invention. In a preferred embodiment, the system is automatically self-adjusting, and the handle is self-aligning. The trigger draw can be set automatically, once the system is assembled.

In a preferred embodiment, the delivery tubing 504 comprises 0.25 inch inside or outside diameter plastic or ruber tubing. The internal diameter can be larger or smaller, as desired or suitable. The tubing 504 can be replaceable and/or reusable, as desired or appropriate.

Figure 3A:
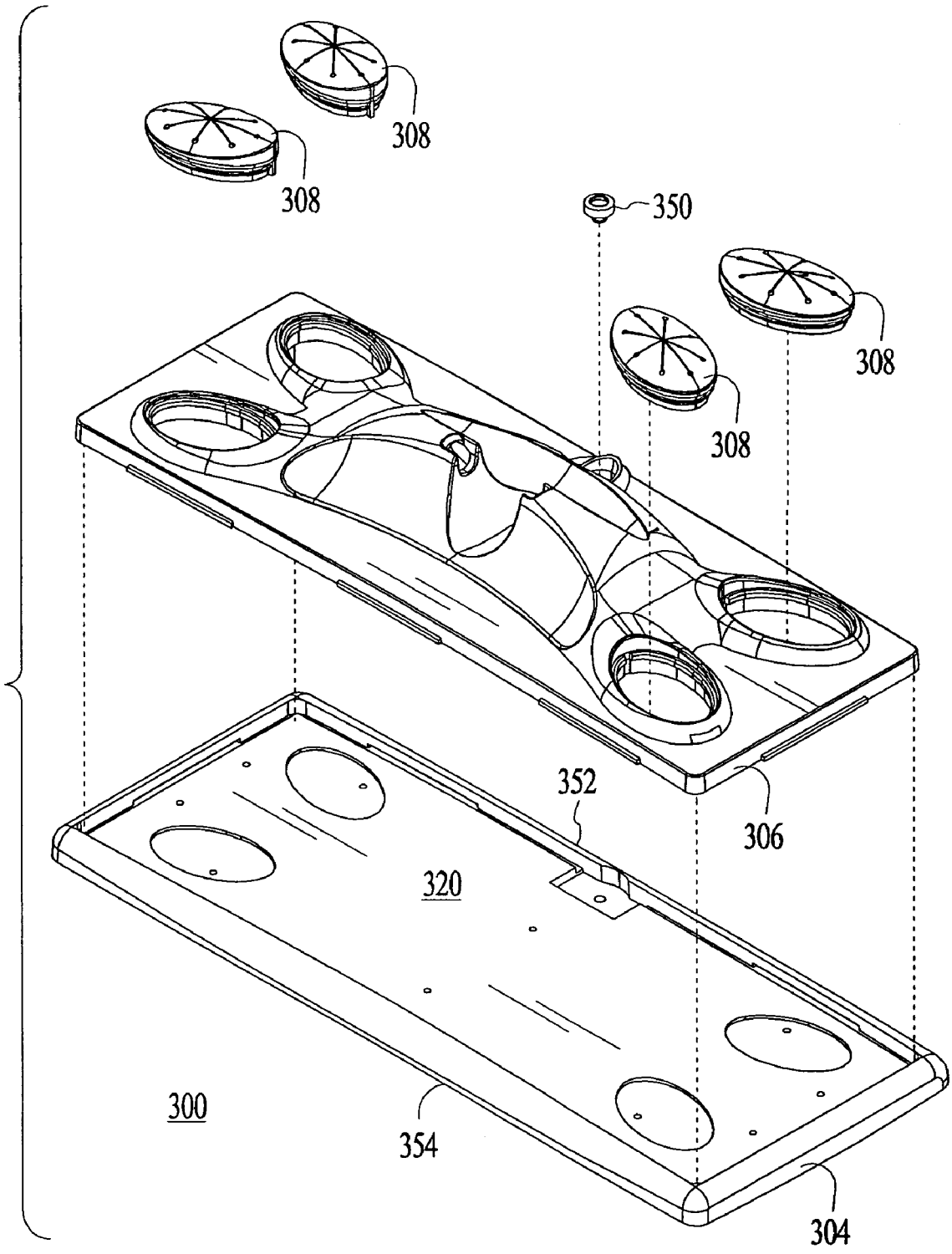
FIG. 3A is a representative exploded view of a preferred embodiment of a head sub-assembly 300 of a cleaning system 100 of the present invention.

FIG. 3A is a representative exploded view of a preferred embodiment of a head sub-assembly 300 of a cleaning system 100 of the present invention. The head sub-assembly 300 consists of a pad portion 304, a formed enclosure portion 306 and about 4 pinchers 308. In a preferred embodiment, the length and width of the pad portion 304 will be about 11 inches and 4 inches, respectively. The enclosure portion 306 will be integrally or otherwise formed, and can be formed separately or as part of the pad portion 304. It will be known to those skilled in the art that the overall size, shape and materials of construction of the pad portion 304 shall be varied upon the specific cleaning application intended.

As shown, nozzle snap 350 is positioned at the front, leading edge 352 of the pad portion 304. The nozzle snap 350 can be replaced with any nozzle portion 700 (as shown best in FIGS. 10A–10E) retaining means. Furthermore, it is also an option to have the head assembly 300 configured such that flow of cleaning fluid 502 flows through the head assembly 300 and out the nozzle assembly 700.

Figure 3B:
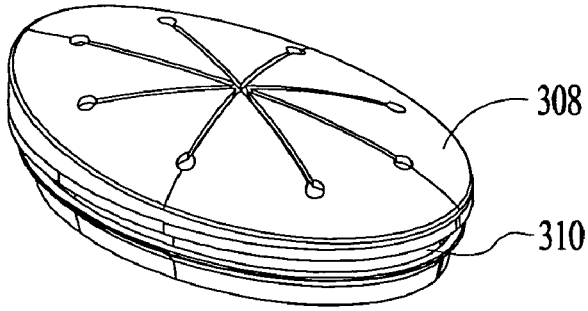
FIG. 3B is a representative isometric view of a preferred embodiment of a pincher 308 of a head sub-assembly 300 of a cleaning system 100 of the present invention.
Figure 3C:
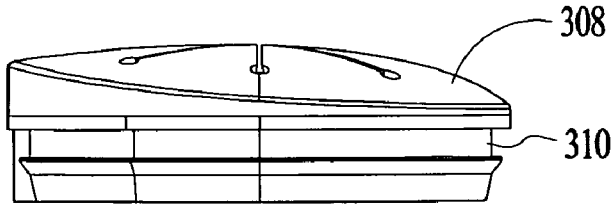
FIG. 3C is a representative side view of a preferred embodiment of a pincher 308 of a head sub-assembly 300 of a cleaning system 100 of the present invention.
Figure 3D:
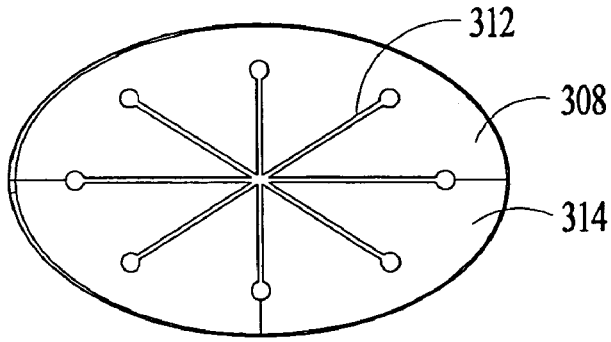
FIG. 3D is a representative top view of a preferred embodiment of a pincher 308 of a head sub-assembly 300 of a cleaning system 100 of the present invention.

FIG. 3B is a representative isometric view of a preferred embodiment of a pincher 308 of a head sub-assembly 300 of a cleaning system 100 of the present invention. FIG. 3C is a representative side view of a preferred embodiment of a pincher 308 of a head sub-assembly 300 of a cleaning system 100 of the present invention. FIG. 3D is a representative top view of a preferred embodiment of a pincher 308 of a head sub-assembly 300 of a cleaning system 100 of the present invention. Pinchers 308 and other mechanical securing means are well known in the art. Such pinchers 308 or other cleaning pad 200 (not shown) securing means will be formed of rubber or other flexible and resilient elastomeric or polymeric material. A circular rib 310 or other mechanical structure is useful for seating and securing the pincher 308 into the enclosure portion 306. The precise design of the slots 312 cut into the top surface 314 of the pinchers 308 can be modified as desired or needed.

Figure 3E:
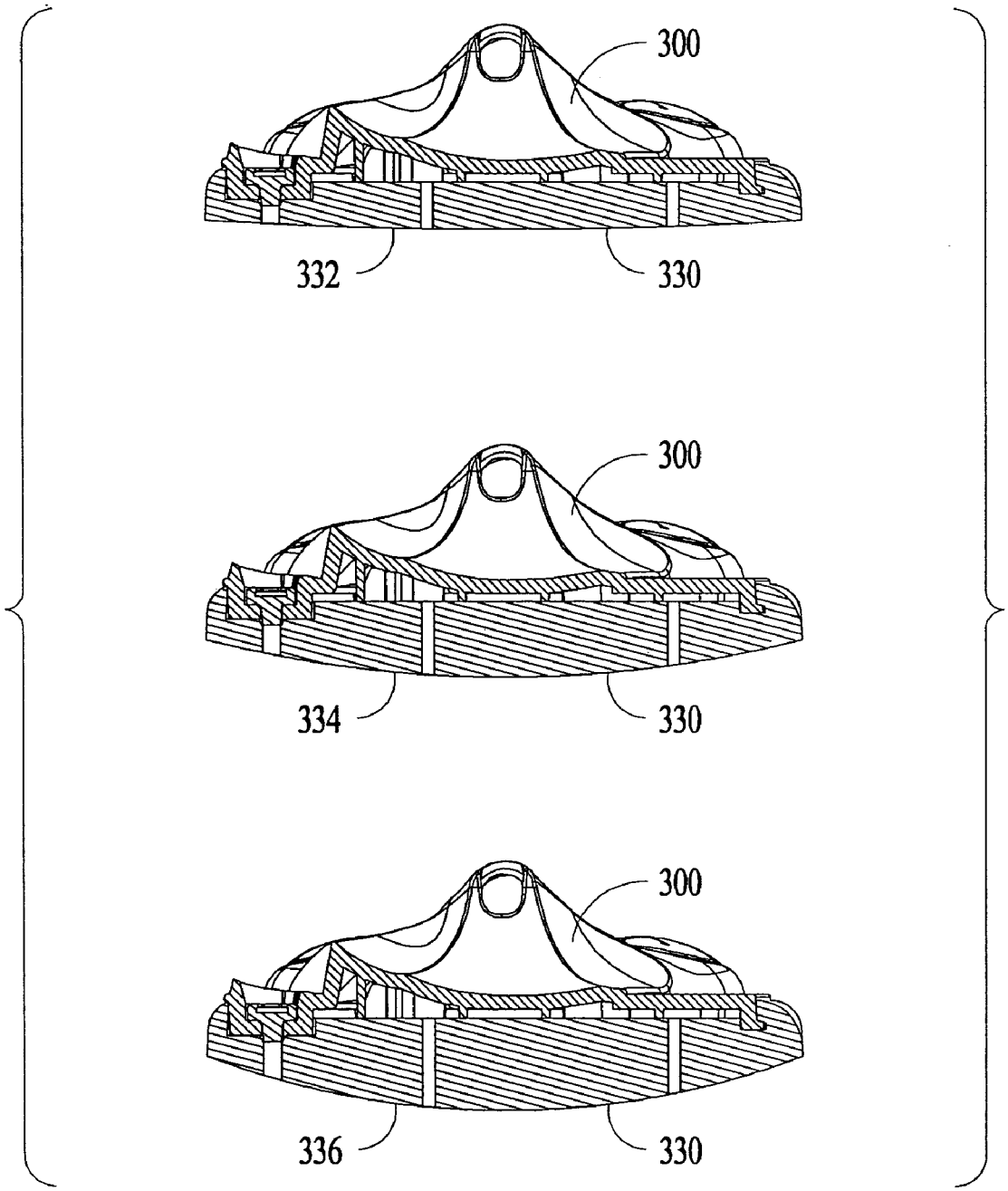
FIG. 3E is a set of three representative side views of preferred embodiments of a convex lower surface 330 of a head sub-assembly 300 of a cleaning system 100 of the present invention.

FIG. 3E is a set of three representative cross section views of preferred embodiments of the convex lower surface 330 of a head sub-assembly 300 of a cleaning system 100 of the present invention, such as shown in at least FIGS. 2 and 3A. It will be understood by those skilled in the art that as the cleaning system 100 of the present invention is used, in a typical floor or ground surface cleaning experience, the system is placed with the lower side 330 of the head assembly 300 facing downward. In the preferred embodiments shown, the lower side 332 of the head assembly 300 is slightly convex, the lower side 334 of the head assembly 300 is more convex, and the lower side 336 of the head assembly 300 is greatly convex. It will be understood that the radius of curvature of the lower surface 332 will be greater than the radius of curvature of lower surface 334 which will be also be greater than the radius of curvature of the lower surface 336.

In the preferred embodiments shown in FIG. 3E, it will be understood that during the cleaning experience, the leading edge 342 of the cleaning head assembly 300 is going to accumulate the greatest amount of debris initially. When the lower surface 330 of the cleaning head assembly 300 is essentially flat, the leading edge 342 of the head assembly 300 the leading edge 342 will become loaded with dirt very quickly as the head 300 is moved forward across the surface to be cleaned 712 (such as shown in FIGS. 10E and 10F). Thus, by providing an increasingly convex shaped lower surface 332, 334 or 336, the leading edge will become decreasingly loaded earlier than the leading edge 342. It will be understood, therefore, that by providing a hemispherically or wedge or other-shaped lower surface 330, the loading of dirt and debris on the leading edge 342 as well as elsewhere on the lower surface 330–336 can be carefully controlled and optimized. It will be understood that the scope of the present invention includes flat as well as convex, wedge shaped, trapezoidal, stepped, or other shaped lower cleaning and contacting surface.

In a preferred embodiment, the cleaning head assembly 300 is optimized to prevent head flipping, such as when applying increased force to the head or when there is an increased frictional force between the cleaning head portion 300 and the floor or other surface being cleaned. In a preferred embodiment, the u-joint 302 is settled into a well or depression or cavity in the top portion of the head assembly 300. It has been found that by bringing the point at which the u-joint 302 is placed relatively closer to the lower surface of the cleaning head assembly, flipping of the head is reduced.

Figure 4A:
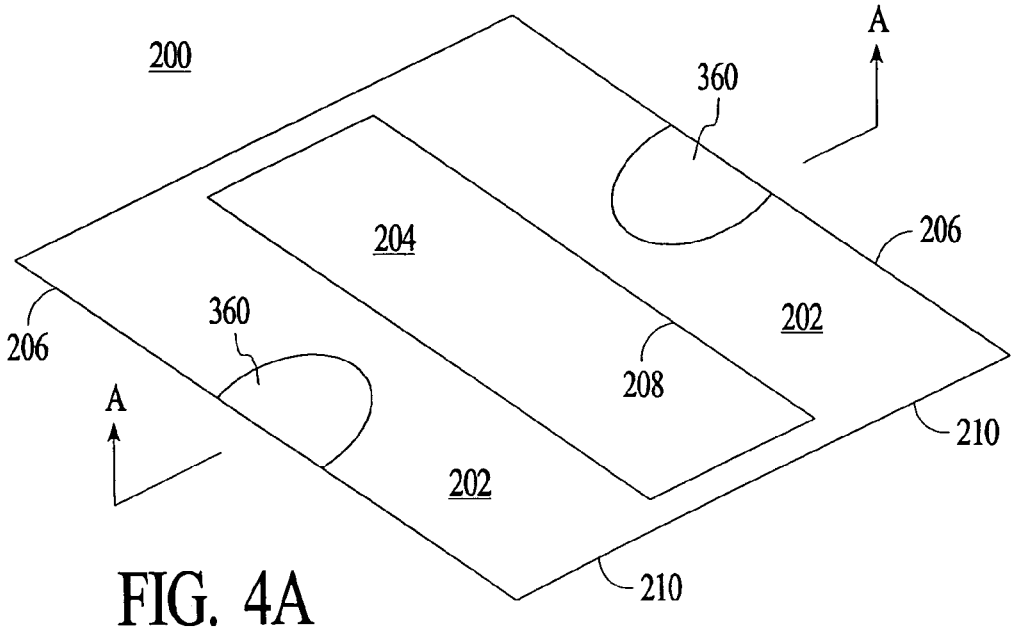
FIG. 4A is a representative view of a preferred embodiment of a cleaning pad 200 of a cleaning system 100 of the present invention.
Figure 4B:
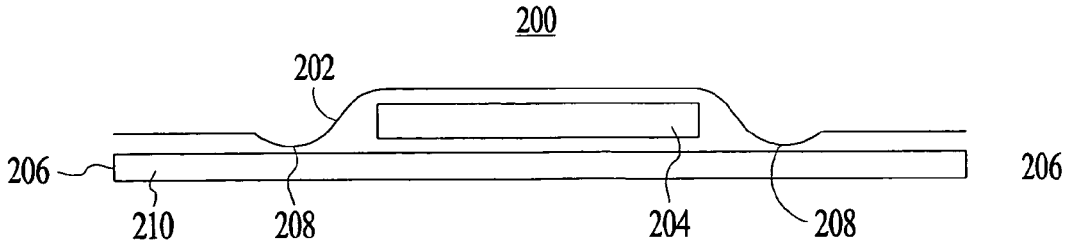
FIG. 4B is a representative cross section view of a preferred embodiment of a cleaning pad 200 of a cleaning system 100 of the present invention, such as taken along A—A.

FIG. 4A is a representative view of a preferred embodiment of a cleaning pad 200 of a cleaning system 100 of the present invention. FIG. 4B is a representative cross section view of a preferred embodiment of a cleaning pad 200 of a cleaning system 100 of the present invention, such as taken along A—A.

With regard to FIGS. 4A and 4B, the cleaning pad 200 consists of a surface (to be cleaned) contacting portion 202 which is the portion of the cleaning pad 200 which comes into direct contact with dirt and debris. This lower, surface contacting portion 202 lifts and locks dirt, dust, debris, hair, fluid, liquid, powder and other spills and materials and any other unwanted matter into itself. On one side of the surface contacting portion 202 there is a narrow strip of absorbent material 204 which has roughly the equivalent, or somewhat larger or somewhat smaller than, length and the width as the pad portion 304 of the head sub-assembly 300 (shown best in FIGS. 1–3A). It will be understood that this absorbent material may be any known material which has the ability to absorb fluid, including superabsorbent materials.

Additionally, a polyethylene film backing layer 206 is bonded at points 208 to the surface contacting portion 202. The film backing layer 206 can be formed of polyethylene or any suitable plastic, rubber, other elastomeric, polymeric or other flexible or otherwise suitable and desirable material which may be available. An advantage of using a fluid impervious material for the backing layer 206 is to prevent fluid leakage into and onto the head sub-assembly 300. Therefore, the use of any essentially fluid or dirt impermeable or impervious material would be useful in this application as backing layer 206 and will, therefore, be claimed within the scope of this patent. It will be known o those skilled in the art that the bonding 208 may be formed by heat sealing or thermo-sealing, various adhesives, any suitable bonding or sealing method, stitching, etc. Thus, absorbent material 204 is retained in a fixed position relative to the lower portion 202 by bonded points 208.

In a preferred embodiment, one or more portions of the cleaning pad 200 and/or the surface contacting portion 202 and/or the absorbent material 204 comprises a point unbonded web material as described in U.S. Pat. No. 5,858,112 issued Jan. 12, 1999 to Stokes et al. and U.S. Pat. No. 5,962,112 issued Oct. 5, 1999 to Haynes et al. or other material such as described by U.S. Pat. No. 4,720,415 issued Jan. 19, 1988 to Vander Wielan et al. or any superabsorbent material such as described in U.S. Pat. No. 4,995,133 issued Feb. 1991 and U.S. Pat. No. 5,638,569 both issued to Newell, U.S. Pat. No. 5,960,508 issued Oct. 5, 1999 to Holt et al., and U.S. Pat. No. 6,003,191 issued Dec. 21, 1999 to Sherry et al., all of which are hereby expressly incorporated by reference herein, in their entirety.

In a preferred embodiment, the cleaning pad 200 and/or the surface contacting portion 202 comprises a spunbond fiber nonwoven web having a basis weight of approximately 68 grams per square meter. The spunbond fibers comprise bicomponent fibers having a side-by-side configuration where each component comprise about 50%, by volume, of the fiber. The spunbond fibers will comprise first and second polypropylene components and/or a first component comprising polypropylene and a second component comprising propylene-ethylene copolymer. About 1% or more or less of titanium oxide or dioxide is added to the fiber(s) in order to improve fiber opacity. The spunbond fiber nonwoven web s thermally bonded with a point unbonded pattern. The nonwoven web is bonded using both heat and compacting pressure by feeding the nonwoven web through a nip formed by a pair of counter-rotating bonding rolls; the bonding rolls comprise one flat roll and one engraved roll. The bonded region of the nonwoven web comprises a continuous pattern that corresponds to the pattern imparted to the engraved roll. Further, the bonded region is applied to the web when it passes through the nip. The bonded region will range between approximately about 27% to about 35% of the area of the nonwoven web and forms a repeating, non-random pattern of circular unbonded regions. Absorbency enhancing or superabsorbent materials, including superabsorbent polymers, powders, fibers and the like may be combined with the cleaning pad 200.

In a preferred embodiment, the unbonded regions of the cleaning pad material 200 as described above are used as the surface 202 to be placed in contact with the surface to be cleaned 712. These unbonded regions, laminated or pressed onto the layer of fibers which is opposite the unbonded region, are highly effective at lifting and locking the dirt, dust, debris, hair, spilled or applied fluids, cleaning solutions, etc. In preferred embodiments, the unbonded portions of the material can be imparted with a scrubby or scruffy surface treatment or composition of material, such as a powder, abrasive, cleaning agent, physical texturing of the fibers, hot air or fluid disruption of the unbonded fibers or other portions to enhance their cleaning capacity and efficacy.

In a preferred embodiment, the absorbent material 204 or elsewhere in the pad 200 comprises a laminate of an air-laid composite and a spunbond fiber nonwoven web. The nonwoven web comprises monocomponent spunbond fibers of polypropylene having a basis weight of approximately 14 grams per square meter. The air-laid composite comprises from about 85% to about % kraft pulp fluff and from about 10% to about 15% bicomponent staple fibers. The bicomponent staple fibers have a sheath-core configuration; the core component comprises polyethylene terephthalate and the sheath component comprises polyethylene. The air-laid composite has a basis weight between about 200 and about 350 grams per square meter and an absorbency of between about 8 and about 11 grams per gram. With regard to absorbency, the stated absorbency was determined under no load by placing a 4"×4" sample in three inches of tap water for three minutes, the sample is then removed from the water and held by a corner allowing it to gravity drip for one minute. The (wet weight—dry weight)/dry weight yields the gram per gram absorbency.

In preferred embodiments of the cleaning pad 204, PET or other hydrophillic fibers useful for scrubbing are employed. Additionally, nylon fibers are useful as they increase the coefficient of friction when they become wet. Increasing the coefficient of friction between the cleaning pad 200 and the surface being cleaned or coated is useful for better cleaning, coating performance. Any component of the cleaning pad 200 may be composed of microfibers and ultra-microfibers having a denier per filament (dpf) less than or equal to about 1.0.

In a preferred embodiment, the cleaning pad 200 is loaded or doped with micro-encapsulated amounts of cleaning compounds. The cleaning fluid itself 502 can be micro-encapsulated, and individual cleaning compounds can be used separately. These would includes, without limitation: anti-microbial, sanitizing and de-odorizing agents, cleaning agents, waxes, polishes or shining agents, softening agents, friction-enhancing compounds or surfaces, perfumes, etc. multi-phases systems may also be applied to a floor or other surface in this way.

When the cleaning pad 200 is positioned such that the pad portion 304 of the head sub-assembly 300 is aligned with the absorbent material 204, and the film backing 206 is adjacent the lower surface of the pad portion 304 of the head subassembly 300, it will be known to those skilled in the art that the rectangular sections 210 can be folded over the lengthwise edges 320 of the pad portion 304, including the leading edge 352 and the back edge 354, and pinched into the slotted portions 312 of the pinchers 308. In this manner, the cleaning pad 200 will be retained on the head portion or assembly 300 in a desired position.

In a preferred embodiment, one or two sections of the absorbent material 202 are removed from the lengthwise portions 320, resulting in one or more notches 260 in the cleaning pad means 200. These notches 260 make it easier for the user to attach the cleaning pad or sheet 200 to the cleaning head assembly 300 without flow or delivery of cleaning fluid liquid 502 is not interrupted or impeded. Providing a double notched 360 cleaning pad or sheet 200 makes it possible for the user to orient the cleaning pad in at least two different configurations without obstructing flow of cleaning solution or fluid 502.

Figure 4C:
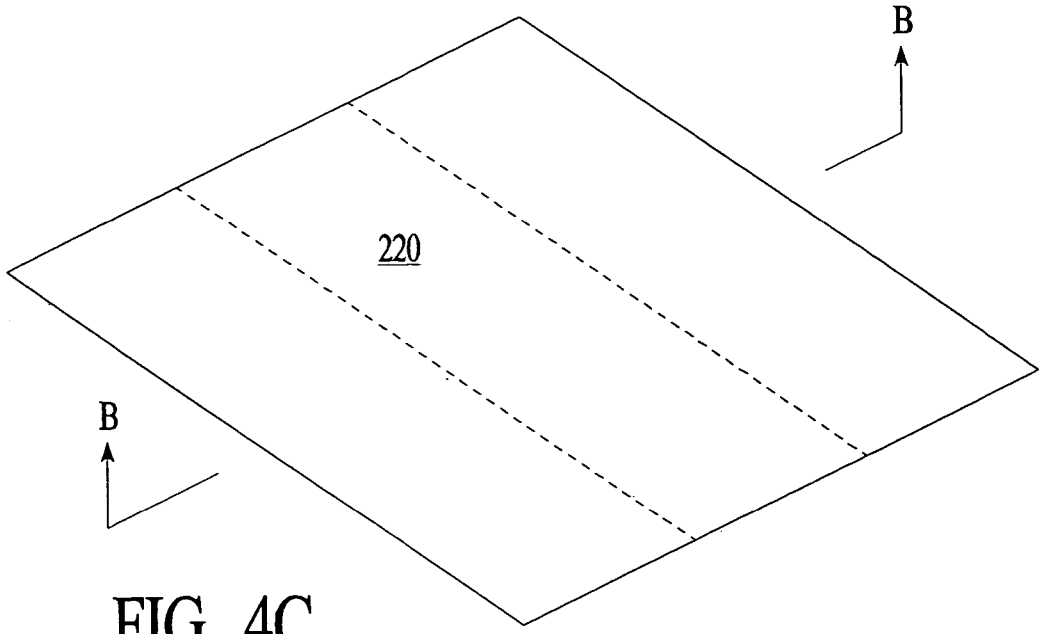
FIG. 4C is a representative view of a preferred embodiment of a cleaning pad or sheet 200 of a cleaning system 100 of the present invention.

As best shown in FIG. 4A, notch 360 located on one or two side panels 210 such as indicated is particularly adapted for use when the contour of the head sub-assembly 300 and the position of the nozzle assembly 700 thereon requires clearance for delivery of cleaning fluid 502 therefrom. This cleaning fluid delivery notch 360 can be shaped or otherwise formed as desired, including perforated section which is torn out by the consumer, a slit portion, various shaped section cut-out, FIG. 4C is a representative view of a preferred embodiment of a cleaning pad or sheet 200 of a cleaning system 100 of the present invention. It will be understood that the cleaning pad 200 used with the cleaning system 100 of the present invention may be any useful or desirable cleaning pad or cloth, unwoven, non-woven or woven materials, co-materials, bonded or laminated materials, for any of various structurally distinct construction. Furthermore, any optimum or possible combination or synthesis of the various embodiments of cleaning pads shown in FIGS, 1, 4A–4F will be useful herein and, therefore, are included within the scope of this invention.

Figure 4D:
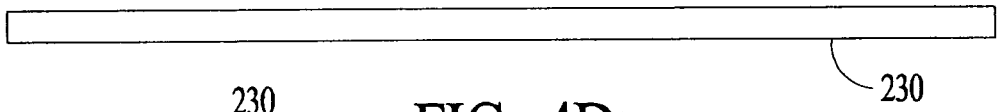
FIG. 4D is a representative cross section view of a preferred embodiment of a cleaning pad 230 of a cleaning system 100 of the present invention, such as taken along B—B.

FIG. 4D is a representative cross section view of a preferred embodiment of a cleaning pad 230 of a cleaning system 100 of the present invention, such as taken along B—B. It will be understood by the foregoing and the following that this invention includes providing a single layer portion of material for the cleaning pad 230 which is capable of being fluid absorbent and will scrub a surface while maintaining integrity. As described, the single layer portion of material cleaning pad 230 can be formed by any material or material-forming process known, including woven and non-woven materials, polymers, gels, extruded materials, laminates, layered materials which are bonded together integrally and thus form a co-material, fused materials, extruded materials, air laying, etc. additionally, materials which are useful include sponges, fabrics, etc.

Figure 4E:
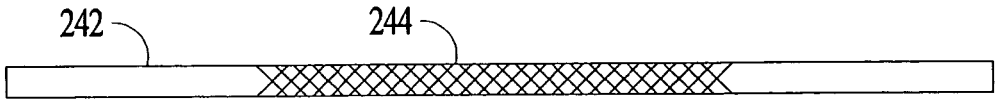
FIG. 4E is a representative cross section view of a preferred embodiment of a cleaning pad 240 of a cleaning system 100 of the present invention.

FIG. 4E is a representative cross section view of a preferred embodiment of a cleaning pad 240 of a cleaning system 100 of the present invention. The cleaning pad 240 is formed of discrete sections or portions. Peripheral edge sections 242 are useful for pinching into the pinchers 308 of the head assembly 300. Adjacent to edge sections can be one or more lengthwise or widthwise orientated strips of material 244 which will have enhanced, preselected, predetermined and other desirable and advantageous properties for cleaning and mopping surfaces.

Figure 4F:
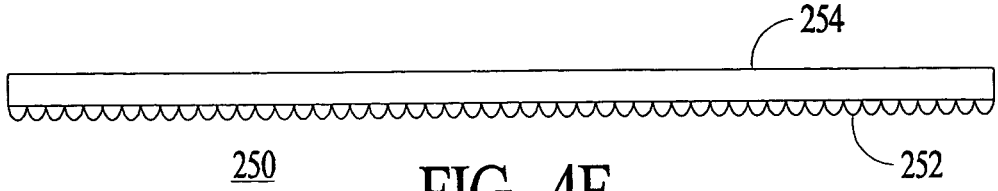
FIG. 4F is a representative cross section view of a preferred embodiment of a cleaning pad 250 of a cleaning system 100 of the present invention.

FIG. 4F is a representative cross section view of a preferred embodiment of a cleaning pad 250 of a cleaning system 100 of the present invention. The cleaning pad 250 is formed of layers of material or is a single layer of material, as discussed above and elsewhere herein, but there is an enhanced surface contacting side 252. This enhanced surface contacting layer or portion of cleaning pad 250 can be optimized for providing a cleaning fluid to the surface, such as with micro capsules or encapsulated fluids or agents. The enhanced surface 252 of the cleaning pad 250 can have scrubbing or abrasive qualities. The enhanced surface 252 can also be formed by a mechanical stamping, bonding, pressing, compression, extrusion, sprayed, sputtered, laminated or other surface forming or affecting process.

Furthermore, the upper layer 254 of the cleaning pad 250 will be formed of any suitable material, if different than that of the enhanced surface 252. In general, however, the upper layer 254 can be formed of a fluid membrane or an impervious or absorbent or other non-absorbent material. Such upper layer 254 can be laminated, heat sealed, fused, compressed with, glued to or otherwise in contact with the surface contacting portion 252.

It will be understood that various absorbent materials 204 are able to absorb and hold fluids, preventing dripping or "squeeze-out", even under applied pressure. Thus, as a user uses the system 100, the cleaning pad 200 will absorb spilled or applied fluids, including cleaning fluids, polishes, special surface coatings, etc. As the user continues through the cleaning experience, whereas conventional materials may tend to allow the absorbed fluid to be re-released, such as at the sides, front or back of the drawing movement of the head assembly 300. This absorbent material 204 or other portion of the cleaning pad 200 will be enhanced to prevent release, drippage or squeeze-out of fluid absorbed therein.

In a preferred embodiment, an internal or external or combination cage, frame, ribcage, scrim or scrim assembly for providing an enhanced structure to the cleaning pad 200 will be used. This scrim or internal frame system for the cleaning pad 200 or the absorbent portion 204 thereof, is intended to provide a structure such that fluid can be absorbed into the cleaning pad 200 but fluid release is avoided. The scrim can also take the form of an open-textured or fishnet-type knit material. The open weave or mesh of the scrim material enhances the capacity to hold, lift and lock or other wise entrap and remove dirt, dust, hair, lint, fuzz, and other debris or soils to be removed by the system 100. The scrim material, being a rigid, more durable, stiffer or thicker material than other portions of the cleaning pad 200, will prevent the cleaning pad 200 from being compressed during use, or otherwise, such that the fluid absorbed into the absorbent portion 204 or elsewhere on the cleaning pad 200 will not be squeezed out. International Publication Number WO 98/42246 published 1 Oct. 1998 describes additional embodiments of a cleaning implement comprising a removable cleaning pad 200, including a scrim and scrim portion for scrubbing, and is incorporated herein in its entirety by reference.

Figure 4G:
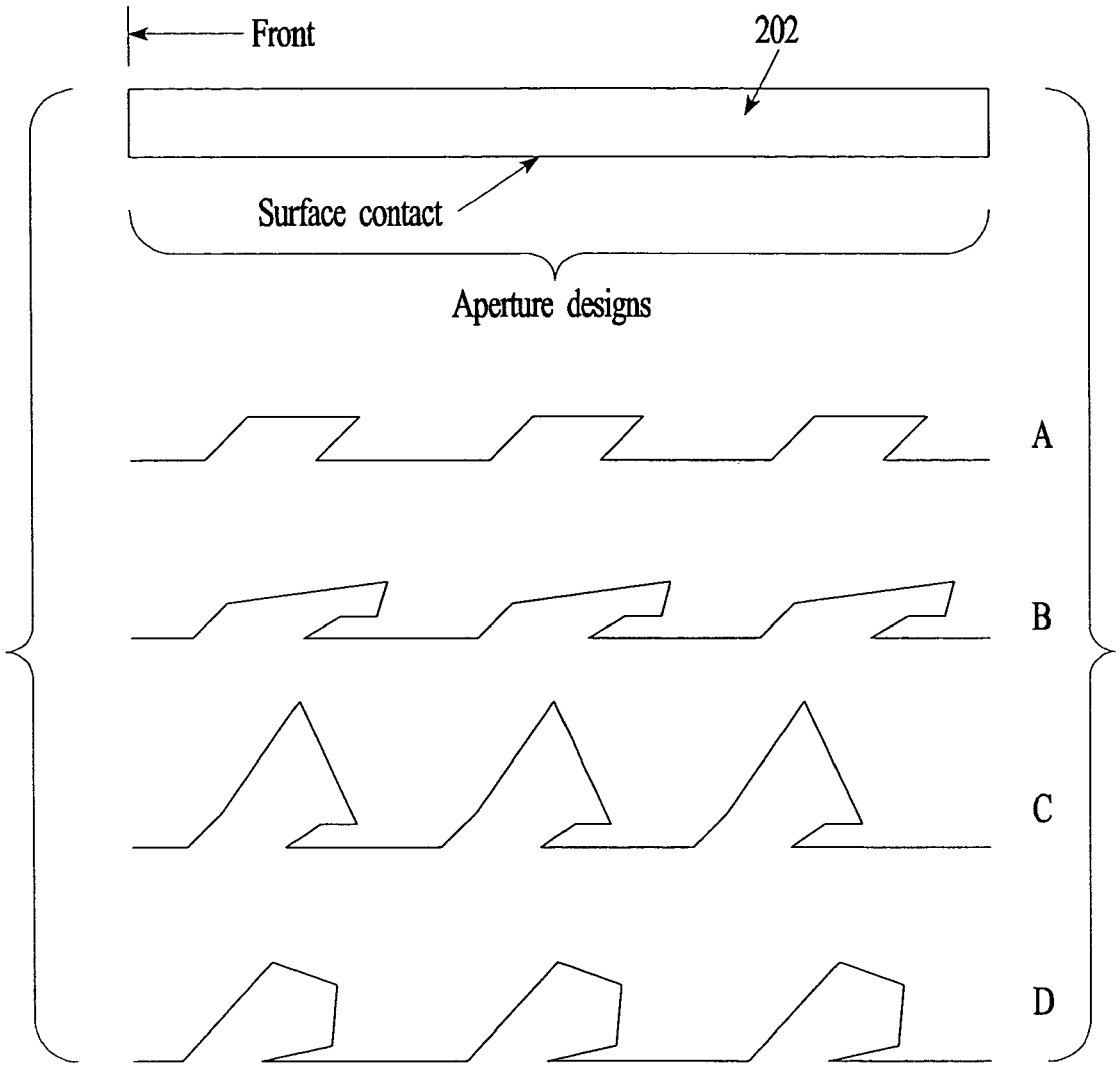
FIG. 4G is a representative cross section view of a preferred embodiment of a cleaning pad 200 and 4 different embossing patterns 203 overlaid the surface contacting portion 202 of a cleaning system 100 of the present invention.

Thus, it will be understood that a preferred embodiment of the cleaning pad 200 of the present invention includes any suitable open pore, burlap or fishnet type sponge structure for snagging, or collecting particulate. Such cleaning pad 200 can be enhanced by providing embossing 203 (as best shown in FIG. 4G) and/or providing slits or pre-cut holes, openings, slots or other apertures, with or without removing material when creating those openings. The surface contacting portion 202 of a cleaning pad 200 can be sliced or slotted prior to assembly, if using more than one component. In a preferred embodiment, the cleaning portion 202 or other portion of the pad 200 is a robust material marketed by PGI as Lavette Super.

In a preferred embodiment, the cleaning pad or sheet 200 comprises strips or stripes of scrubbing or abrasive material. Such abrasive will be surface-safe, so as not to damage the finish, polish or other desirable qualities of a smooth floor or other surface to be cleaned In preferred embodiments, the cleaning pad 200 has an absorbent portion 204 which is comprised of a plurality of layers of absorbent material. The layers can be formed by individual slices, a single, rolled section of material which is simply flattened into a layered, absorbent portion 204. As described, such can be formed of rayon, polyester, nylon material, pulp, combinations and composites and multi-and bi-component materials can be used.

FIG. 4G is a representative cross section view of a preferred embodiment of a cleaning pad 200 and 4 different embossing patterns 203 overlaid the surface contacting portion 202 of a cleaning system 100 of the present invention. The surface contacting portion 202 can contain apertures 203 designed to scoop up and entrap dirt, hair, crumbs, and dust. Aperture designs 203 include many, such as those shown as A, B, C, and D. The aperture designs 203 shown are merely representative of a few of the possible designs, and while others will become apparent to those skilled in the art, they will be covered within the scope and purview of the present invention.

Figure 5A:
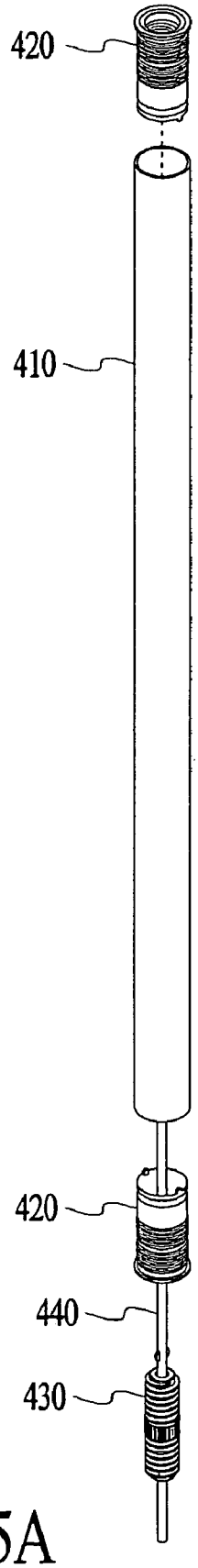
FIG. 5A is a representative exploded view of a preferred embodiment of a mid portion 400*a* of a handle sub-assembly 400 (as shown in FIGS. 1 and 2) of a cleaning system 100 of the present invention.

FIG. 5A is a representative exploded view of a mid portion 400*a* of a handle sub-assembly 400 such as shown in FIGS. 1 and 2 of a cleaning system 100 of the present invention. It will be known based on the foregoing and the following that the mid portion 400*a* of the handle sub-assembly 400 can have various embodiments, and but essentially a single preferred embodiment are described herein. The handle sub-assembly 400 consists of a shaft section 410 with a sleeve member 420 pressed onto place at either end. Further, it will be known to those skilled in the art that additional means for securing the sleeve members 420 into the ends of the shaft sections 410 will be available, including threaded ends, pins, welding, other types of press fittings, compression and expansion fittings or adhesives, and other common or custom coupling or attachment means, etc.

Figure 5E:
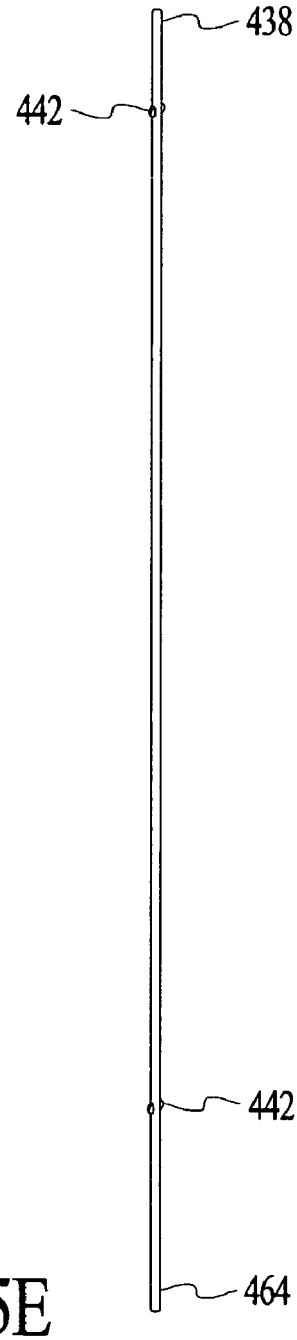
FIG. 5E is a representative view of a preferred embodiment of a push rod 440 of a handle sub-assembly 400 of a cleaning system 100 of the present invention.
Figure 5B:
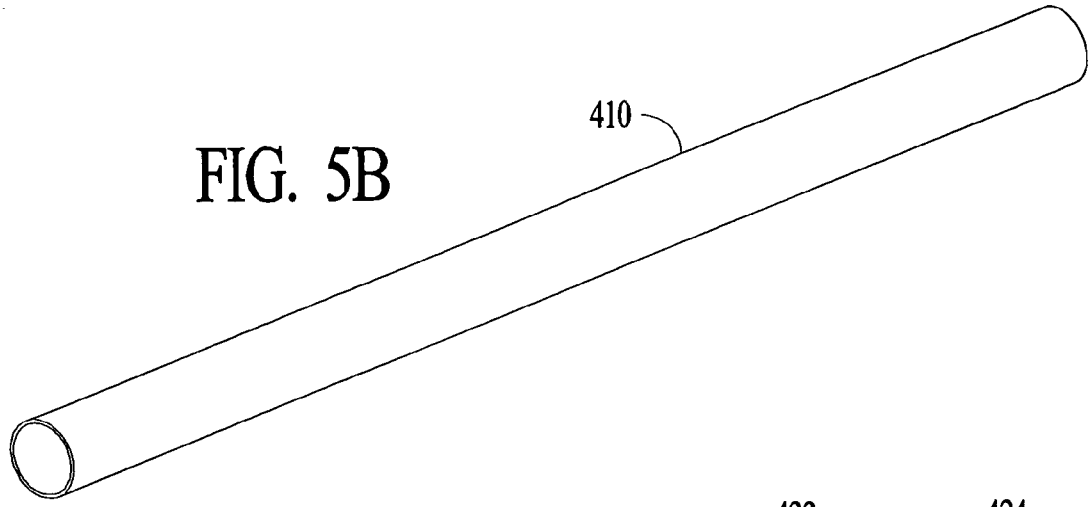
FIG. 5B is a representative isometric view of a preferred embodiment of a shaft section 410 of a handle sub-assembly 400 of a cleaning system 100 of the present invention.

FIG. 5B is a representative isometric view of a preferred embodiment of a shaft section 410 of a handle sub-assembly 400 of a cleaning system 100 of the present invention. The tubular shaft section 410 can be formed of any of a variety of materials and methods, including but not limited to the following materials and methods of forming those: glass, paper, cardboard, wood, any metals including steels, aluminum, titanium, alloys including chrome, molybdenum, plastics, composites including fiber glass, formica, natural and synthetic, man-made materials, canes, tubular members made of carbon components, crystals, fibers, alloys, etc., by extrusion, pressing, braking, rolling sheet portions, stamping, carved, otherwise shaped, formed, prepared and/or assembled.

Figure 5D:
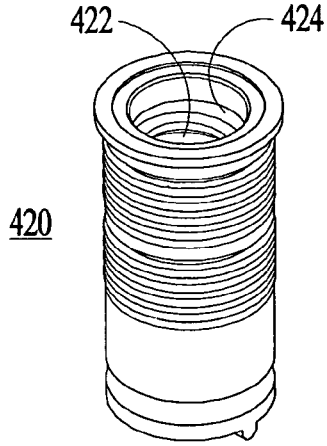
FIG. 5D is a representative isometric view of a preferred embodiment of a sleeve member 420 of a handle sub-assembly 400 of a cleaning system 100 of the present invention.
Figure 5C:
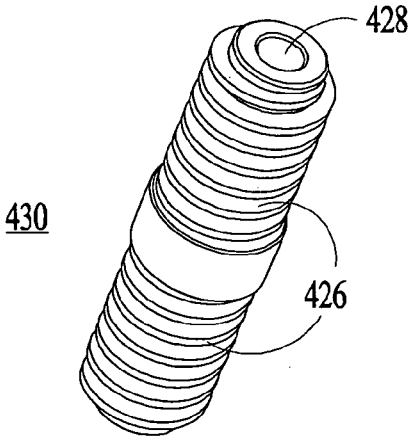
FIG. 5C is a representative isometric view of a preferred embodiment of a threaded shaft coupling member 430 of a handle sub-assembly 400 of a cleaning system 100 of the present invention.

FIG. 5C is a representative isometric view of a preferred embodiment of a shaft coupling 430 of a handle sub-assembly 400 of a cleaning system 100 of the present invention. FIG. 5D is a representative isometric view of a preferred embodiment of a sleeve member 420 of a handle sub-assembly 400 of a cleaning system 100 of the present invention.

The threaded shaft coupling member 430 has one or more helically threaded portions 426 which align and thread into matching threaded portion 424 in the sleeve member 420. It will be apparent, therefore, that by coupling multiple shaft sections 410 together with shaft coupling members 430 between different shaft sections 410, a handle sub-assembly 400 having essentially any desired length or other geometry may be obtained. Additionally, an opening or hole 428 extends through the coupling member 430.

FIG. 5E is a representative view of a preferred embodiment of a push rod 440 such as of a mid-portion 400*a* handle sub-assembly 400 of a cleaning system 100 of the present invention. The push rod 440 extends through holes 422 passing through the sleeve members 420 and through the openings 428 through the coupling members 430. Local deformations 442 at either end of the push rod 440 serve as detents or stops for controlling translation of the push rod 440 as desired.

Figure 5F:
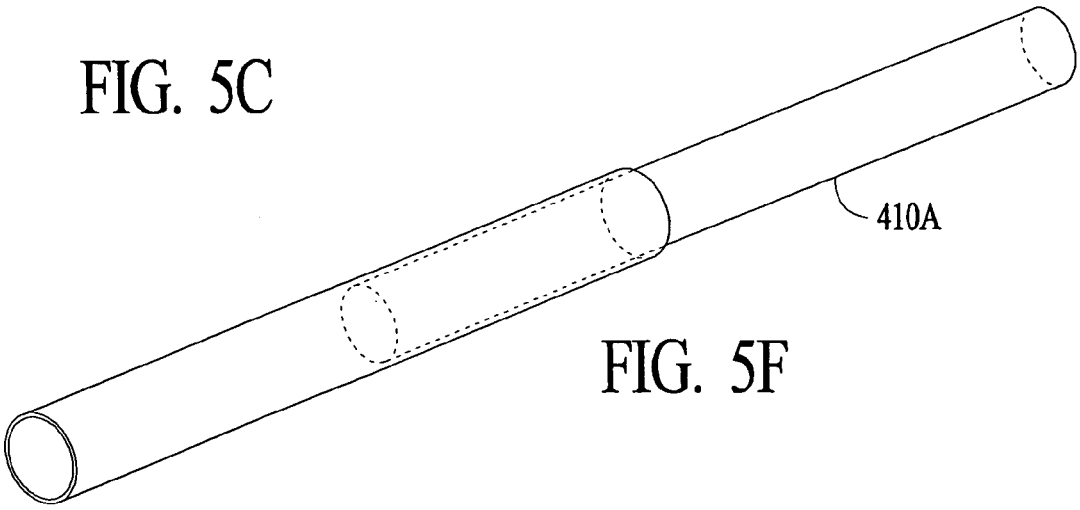
FIG. 5F is a representative view of a preferred embodiment of a telescoping shaft section 410*a* of a handle sub-assembly 400 (as shown in FIGS. 1 and 2) of a cleaning system 100 of the present invention.

FIG. 5F is a representative view of a preferred embodiment of a telescoping shaft section 410*a* of a handle sub-assembly 400 (as shown in FIGS. 1 and 2) of a cleaning system 100 of the present invention.

It will be understood by the foregoing and the following that the handle sub-assembly 400 of a cleaning system 100 can comprise one or more shaft sections 410 in a coupled, hinged, telescoping, collapsible, expanding or other configuration. A plurality of telescoping or collapsing shaft sections 410 in combination is space-saving, convenient to use and economical to manufacture, and is included within the scope of the present invention.

Figure 6A:
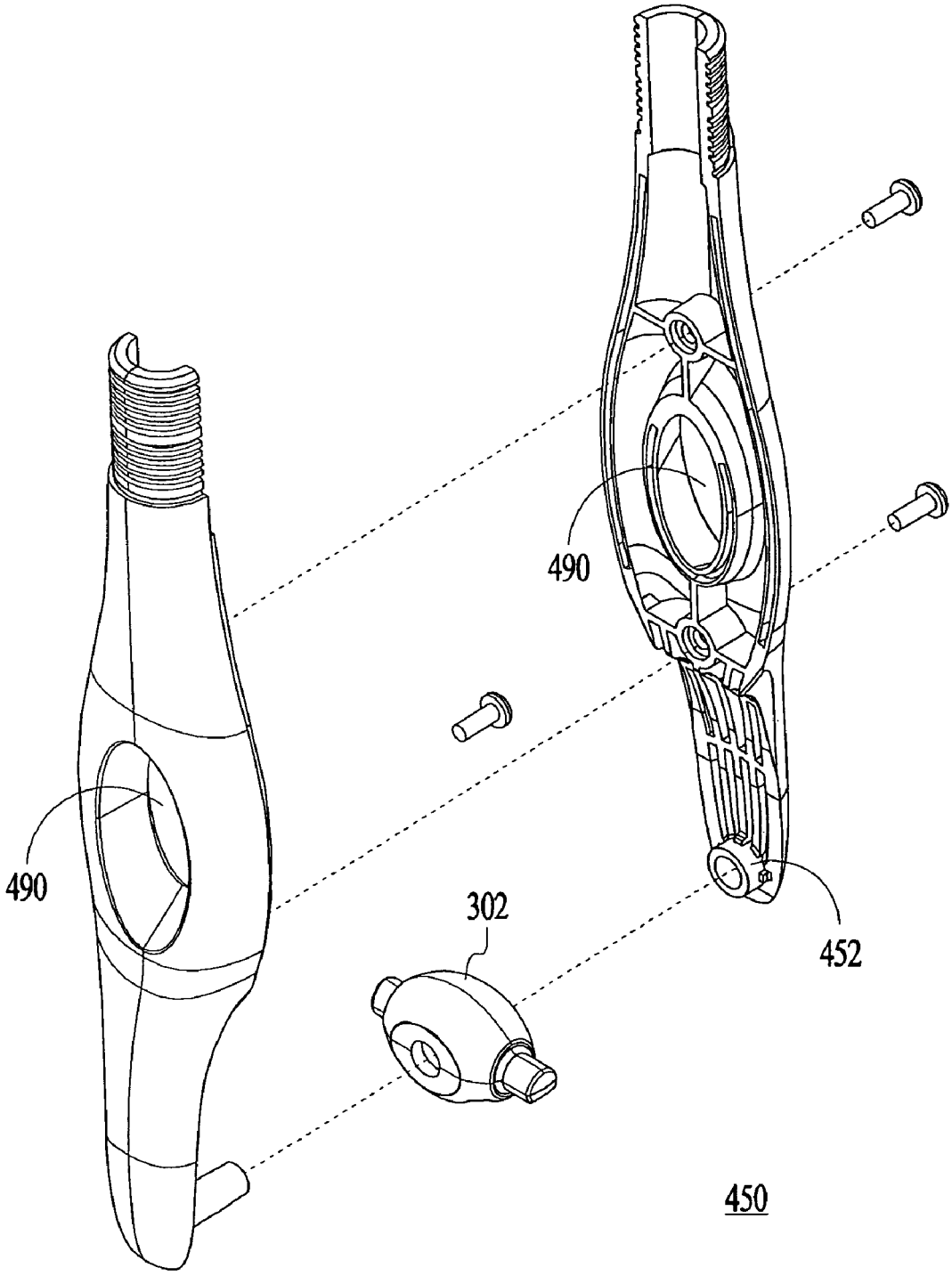
FIG. 6A is a representative isometric view with hidden lines of a preferred embodiment of a yoke section 450 and universal joint 302 of a handle sub-assembly 400 of a cleaning system 100 of the present invention.

FIG. 6A is a representative isometric view with hidden lines of a preferred embodiment of a yoke section 450 and a universal joint 302 of a handle sub-assembly 400 of a cleaning system 100 of the present invention. The yoke section 450 can be formed by injection molding, extrusion, etc. A coupling portion 452 is adapted for coupling to the universal joint 302 which couples to the head assembly 300 as shown in FIG. 1. Thus, upward and downward motion of the handle assembly 400 can be achieved. Furthermore, by mounting the universal joint 302 onto the head assembly 300, the universal joint 302 can swivel and the handle assembly 400 can move laterally. A central opening 490 through the yoke section 450 is particularly useful for passing a fluid delivery tube 504 through for attachment of a nozzle sub-assembly 700 to a head portion 300.

Figure 6B:
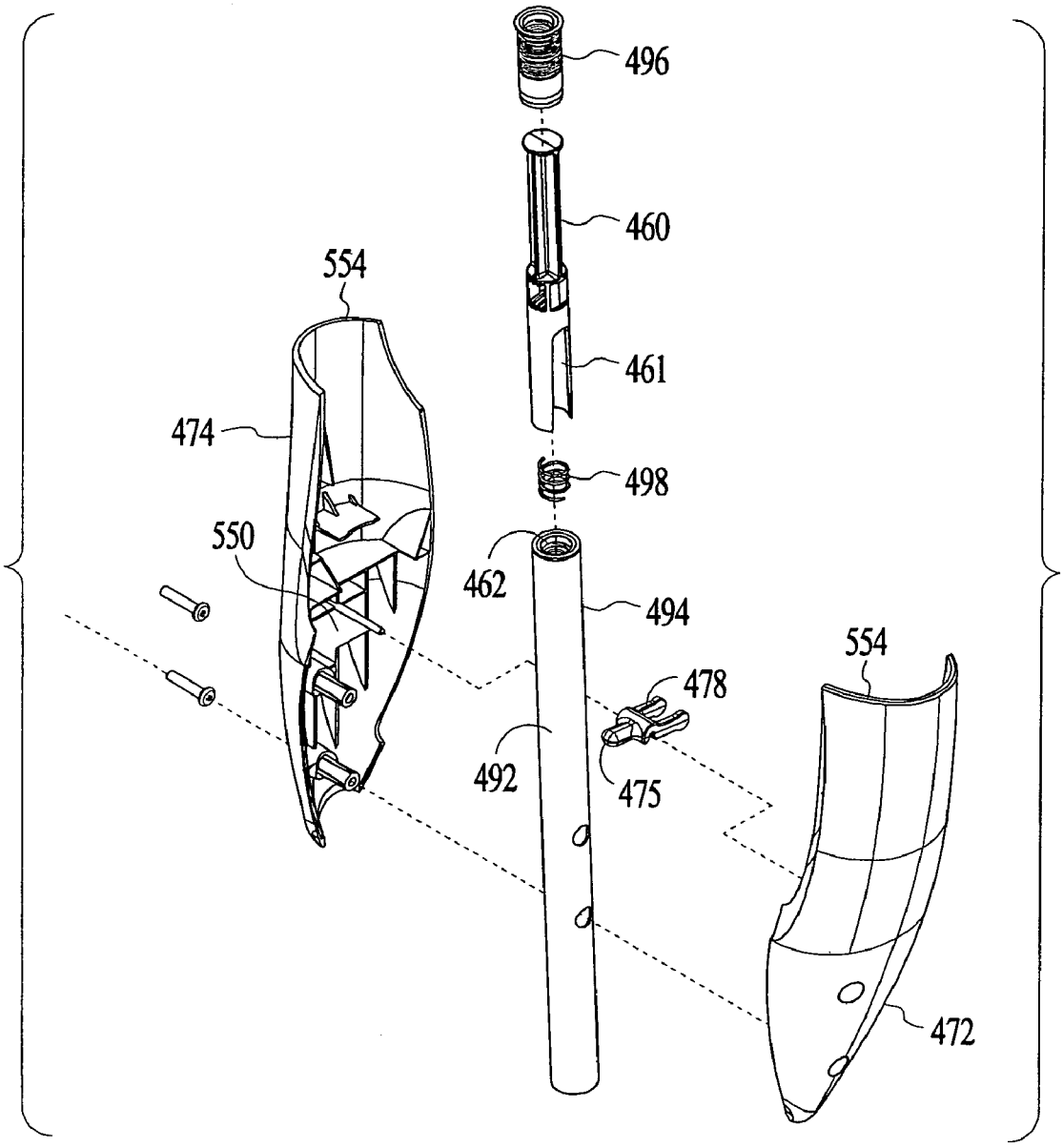
FIG. 6B is a representative exploded view of a preferred embodiment of a holster sub-assembly 470 of a cleaning system 100 of the present invention.
Figure 6C:
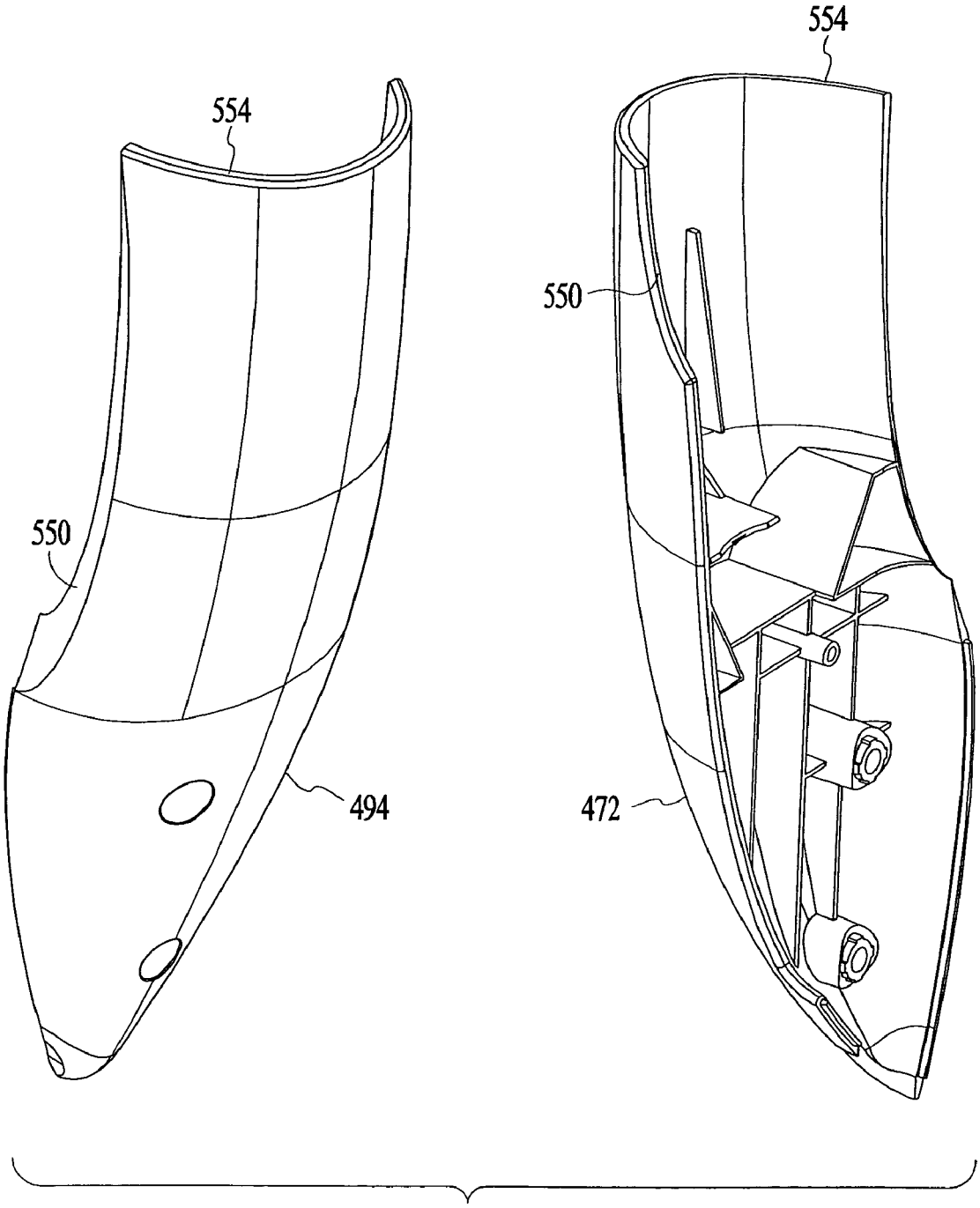
FIG. 6C is a representative isometric view of left side cradle portion and right side cradle portion of a preferred embodiment of a holster sub-assembly 470 of a cleaning system 100 of the present invention.

FIG. 6B is a representative exploded view of a preferred embodiment of a holster sub-assembly 470 of a cleaning system 100 of the present invention. FIG. 6C is a representative isometric view of left side cradle portion 472 and right side cradle portion 474 of a preferred embodiment of a holster sub-assembly 470 of a cleaning system 100 of the present invention.

The left side cradle portion 472 and right side cradle portion 474 can be injection or blow molded of rigid plastic. Tab portions, mating adhesion points, or other coupling means on the mating faces of the left side cradle portion 472 and right side cradle portion 474 couple the cradle portions together detachably or permanently.

As shown in FIG. 6B, cylindrical slide member 460 fits within hollow internal opening 462 at the proximal end 494 of the tubular section 492. Therefore, the slide member 460 is moved distally through the hollow internal opening 462 at the end of the tubular section 492. Distally, it engages bearingly upon valve lever 478 or other structure extending trans-axially through or at least into tubular section 492 as shown. Proximally, a shaft coupling member 496 retains the slide member 460, which is biased proximally by spring 498 or other biasing member, disposed within the opening 462 of tubular shaft section 492 between the proximal end portion 461 of the slide 460 and the biasing arm 475 of the lever portion 478.

Figure 7A:
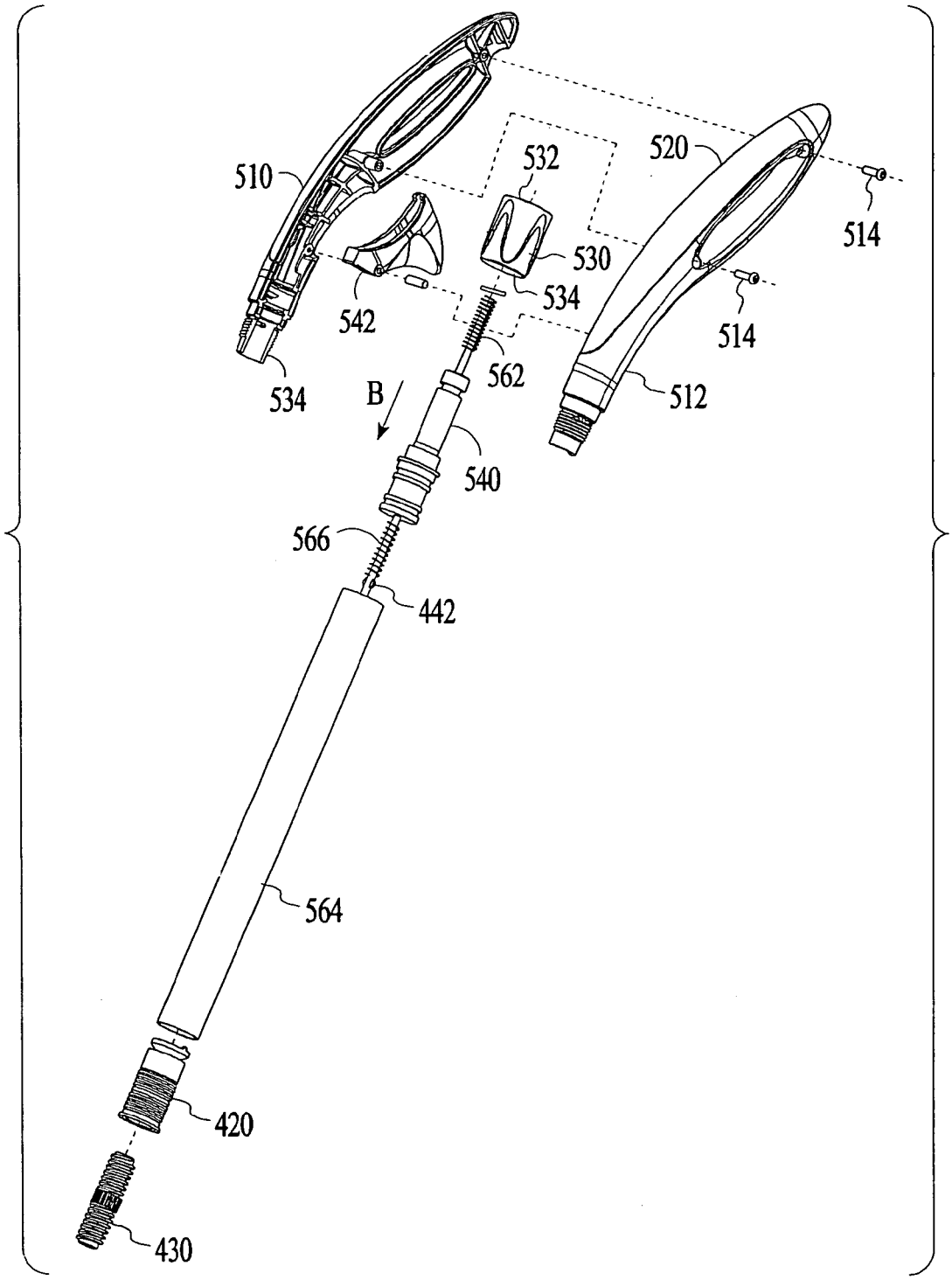
FIG. 7A is a representative exploded view of a preferred embodiment of a proximal end 501 of a handle sub-assembly 400 of a cleaning system 100 of the present invention.
Figure 7B:
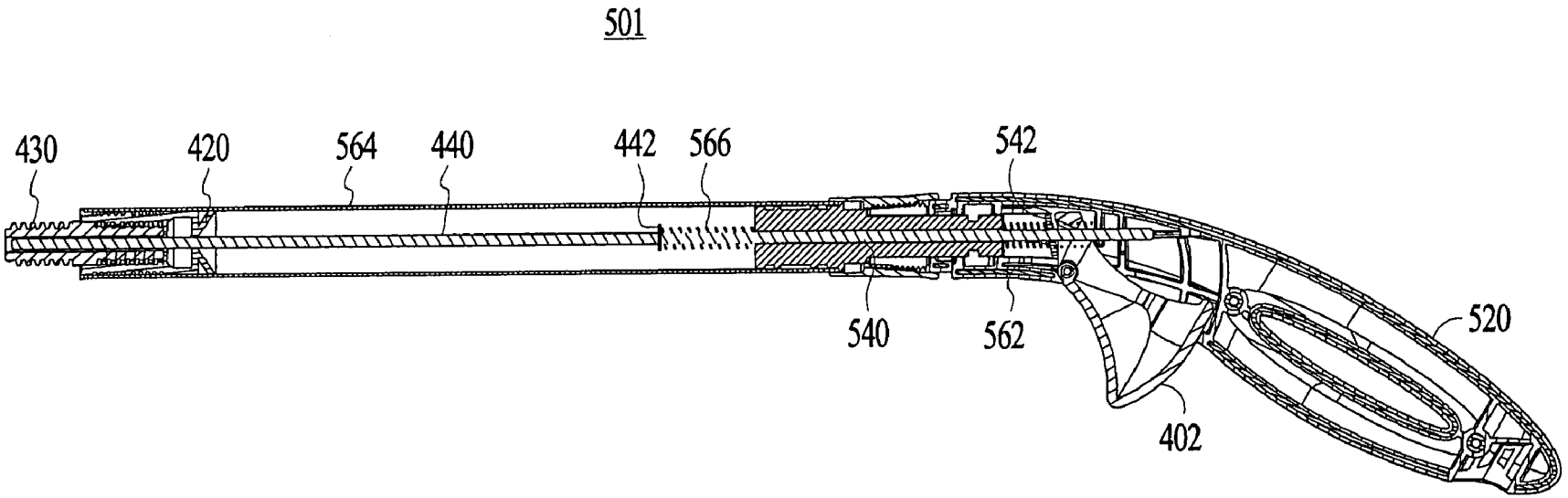
FIG. 7B is a representative section view of a preferred embodiment of a proximal end 501 of a handle sub-assembly 400 of a cleaning system 100 of the present invention.

FIG. 7A is a representative exploded view of a preferred embodiment of a proximal end 501 of a handle sub-assembly 400 of a cleaning system 100 of the present invention. FIG. 7B is a representative section view of a preferred embodiment of a proximal end 501 of a handle sub-assembly 400 of a cleaning system 100 of the present invention.

As shown, the right handle portion 510 couples with the left handle portion 512 through detachable or permanent mating means 514. Together with an optional overmolded portion 520, the three sections form an ergonomic hand grip for the distal end 500 of the handle assembly 400. As shown, trigger member 402 is retained within the assembly 500 with trigger pin 560. First spring means 562 biases the trigger in a set position.

As shown, upper portion 532 of the collar portion 530 engages the distal ends 534 of right and left handle portions 510 and 512, respectively. Thus, handle coupling 540 is retained between the collar 530 and the right and left handle portions 510 and 512, respectively, and slides within proximal shaft portion 564. Pull rod 440 extends through handling coupling 540 and proximal shaft portion 564. Second spring means 566 is positioned over the pull rod 440 retained in position between slide stop 442. At a distal end, shaft sleeve 420, as shown in FIGS. 5A and 5D, couples to proximal shaft portion 564, with shaft coupling member 430 threadingly engaged thereto, as shown in FIGS. 5A and 5C.

As trigger 402 is squeezed manually or otherwise, bearing surface 542 on trigger 402 bears thrustingly upon proximal end 544 of handle coupling 540 to drive the handle coupling 540 distally in direction B. The distal end 546 of handle coupling 540 bears upon push rod 440 through second spring means 566. In a preferred embodiment, the handle assembly 501 is automatically self-adjusting. Upon initial assembly, a first draw on the trigger 402 sets the correct distances for trigger travel as it translates to activation of the valve assembly 800 on the reservoir 500. The action is a modified ratchet mechanism as found on caulking guns and other extrusion or pump devices.

Figure 8A:
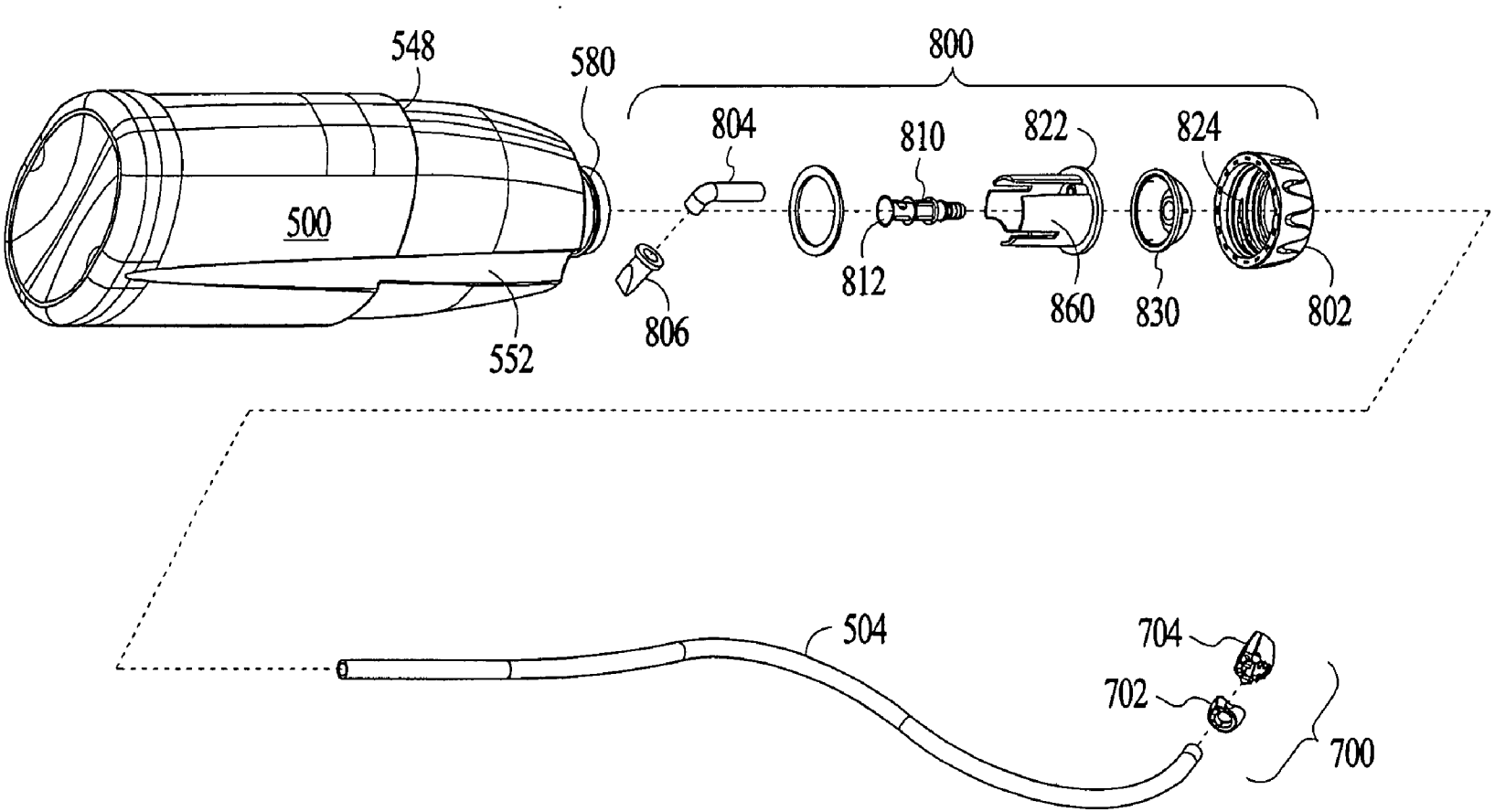
FIG. 8A is a representative exploded view of a preferred embodiment of a cleaning fluid reservoir 500 and valve sub-assembly 800 with flexible fluid delivery tubing 504 and nozzle assembly 700 of a cleaning system 100 of the present invention.
Figure 8B:
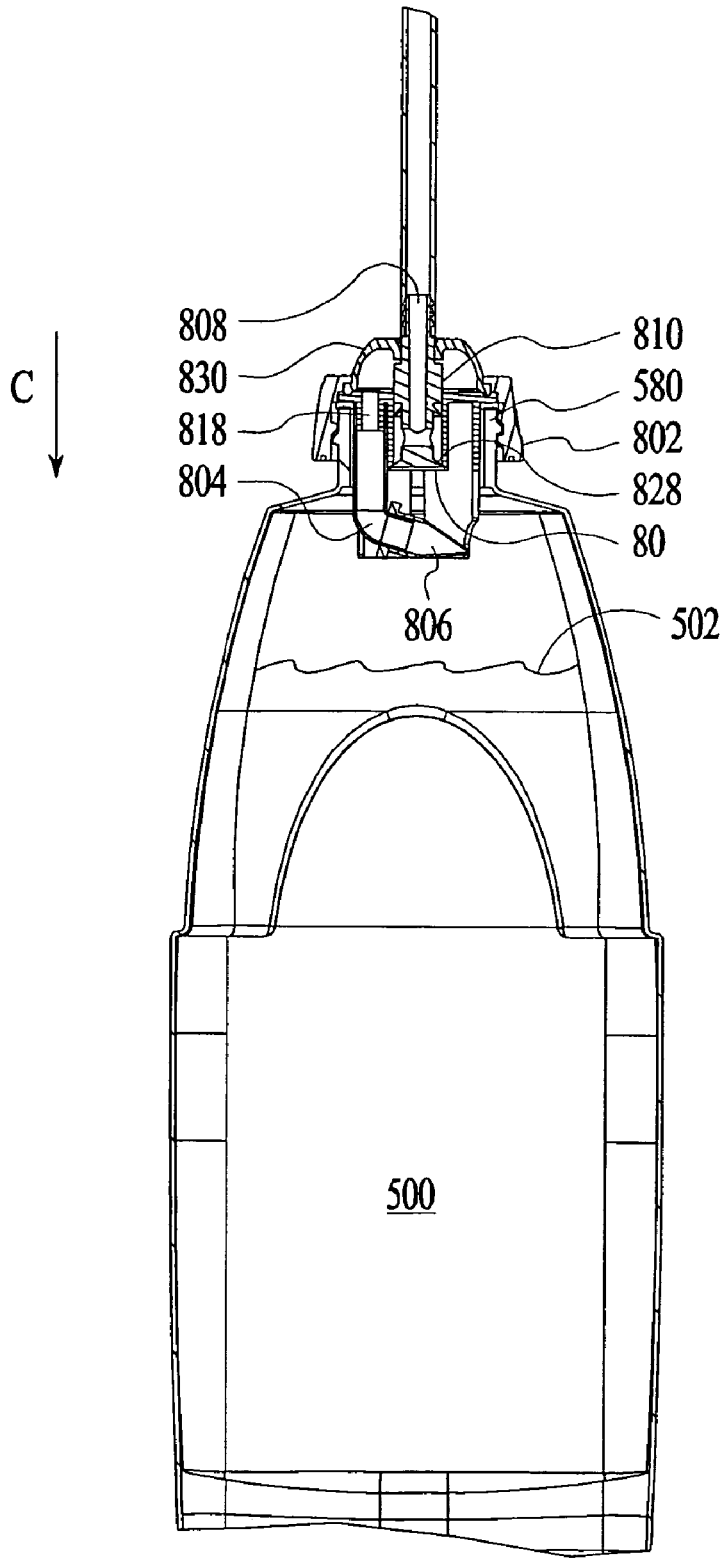
FIG. 8B is a representative section view of a preferred embodiment of a cleaning fluid reservoir 500 and valve sub-assembly 800 with flexible fluid delivery tubing 504.
Figure 8C:
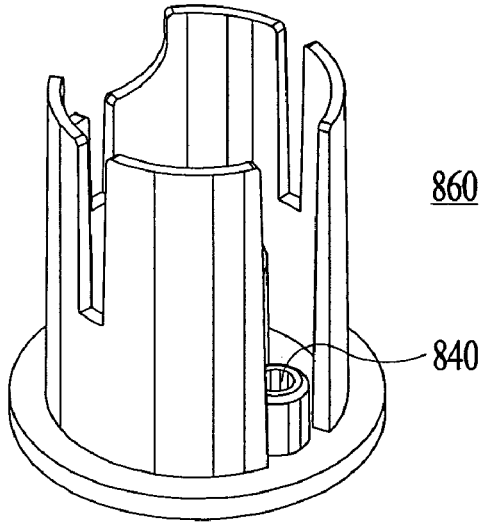
FIG. 8C is a representative upper isometric view of a preferred embodiment of a valve cap portion 860 of a valve sub-assembly 800 of a cleaning system 100 of the present invention.
Figure 8D:
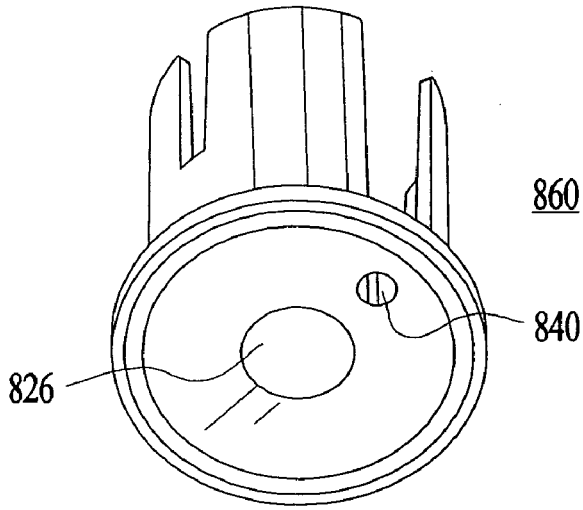
FIG. 8D is a representative lower isometric view of a preferred embodiment of a valve cap portion 860 of a valve sub-assembly 800 of a cleaning system 100 of the present invention.
Figure 8E:
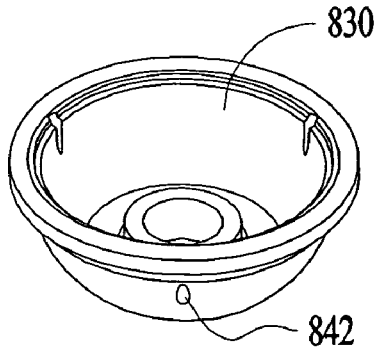
FIG. 8E is a representative isometric view of a preferred embodiment of a flex dome portion 830 of a valve sub-assembly 800 of a cleaning system 100 of the present invention.
Figure 8F:
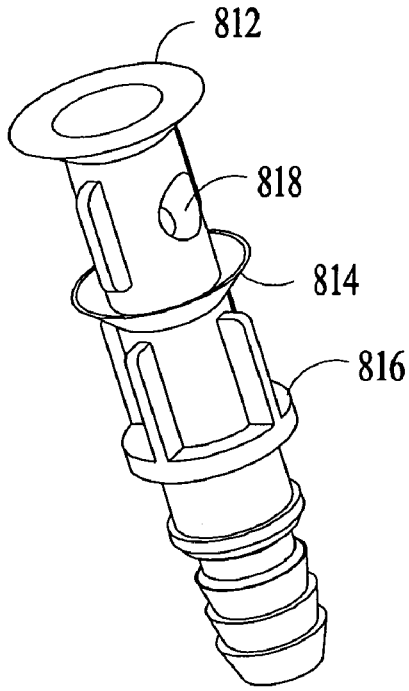
FIG. 8F is a representative isometric view of a preferred embodiment of a valve post 810 of a valve sub-assembly 800 of a cleaning system 100 of the present invention.
Figure 8G:
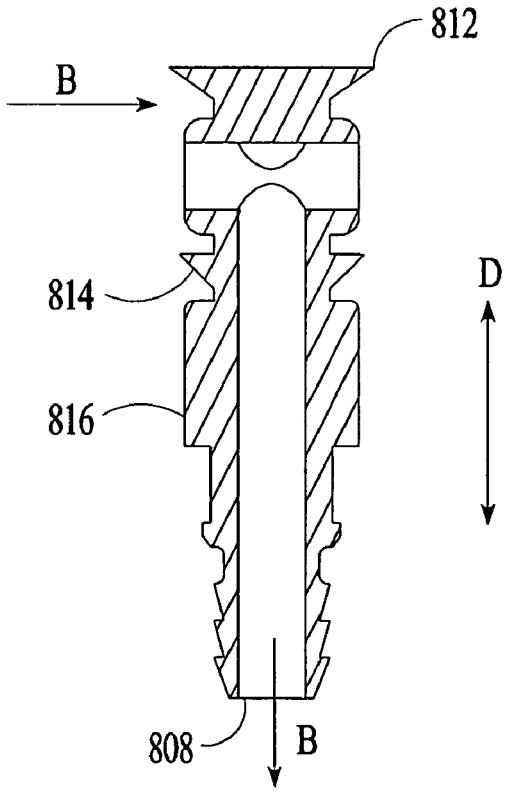
FIG. 8G is a representative section view of a preferred embodiment of a valve post 810 of a valve sub-assembly 800 of a cleaning system 100 of the present invention.
Figure 8H:
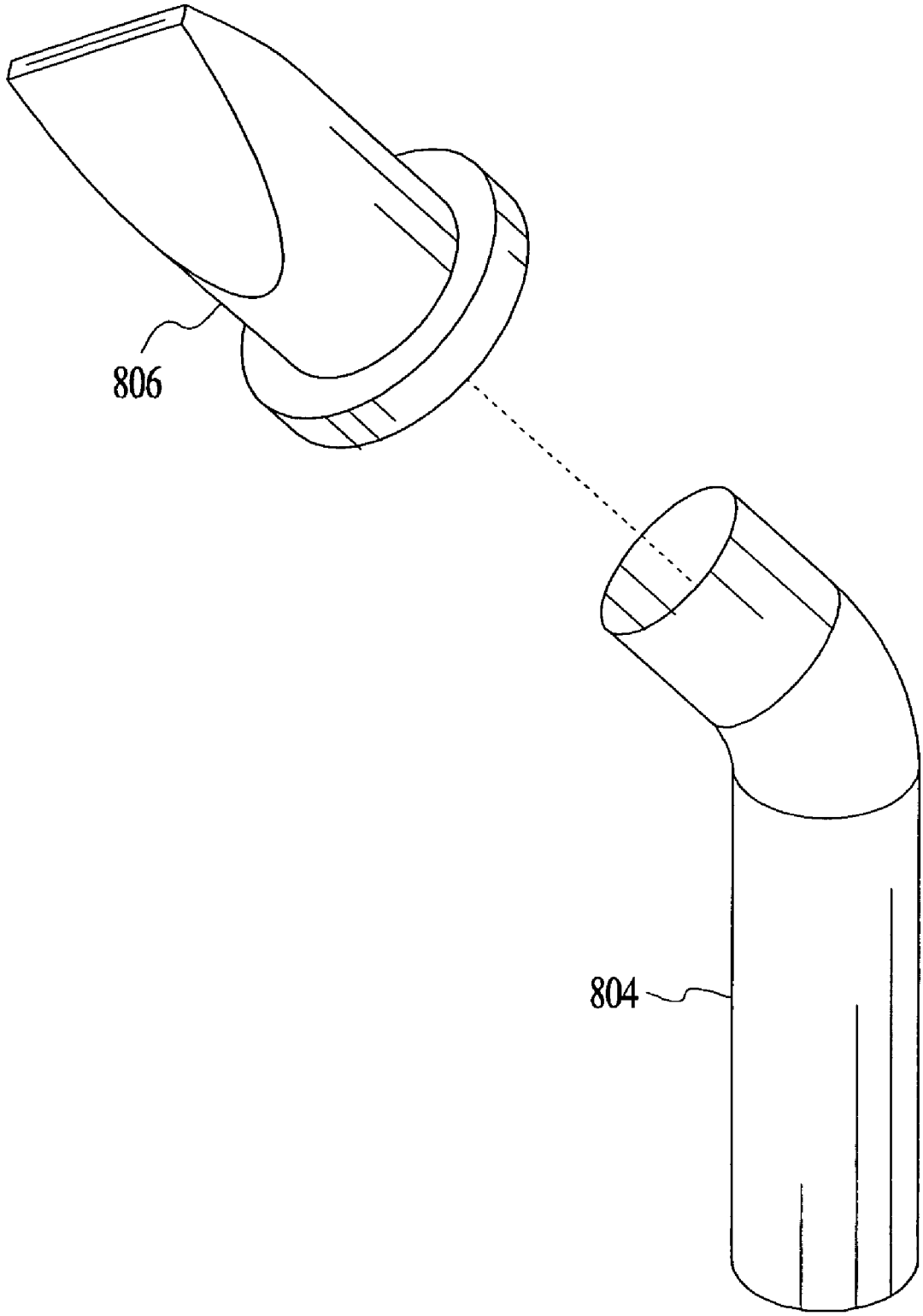
FIG. 8H is a representative detail view of a preferred embodiment of a dip tube 804 and duck bill valve 840 of a valve sub-assembly 800 of a cleaning system 100 of the present invention.

FIG. 8A is a representative exploded view of a preferred embodiment of a cleaning fluid reservoir 500 and valve sub-assembly 800 with flexible fluid delivery tubing 504 and nozzle assembly 700 of a cleaning system 100 of the present invention. FIG. 8B is a representative section view of a preferred embodiment of a cleaning fluid reservoir 500 and valve sub-assembly 800 with flexible fluid delivery tubing 504. FIG. 8C is a representative upper isometric view of a preferred embodiment of a valve cap portion 860 of a valve sub-assembly 800 of a cleaning system 100 of the present invention. FIG. 8D is a representative lower isometric view of a preferred embodiment of a valve cap portion 860 of a valve sub-assembly 800 of a cleaning system 100 of the present invention. FIG. 8E is a representative isometric view of a preferred embodiment of a flex dome portion 830 of a valve sub-assembly 800 of a cleaning system 100 of the present invention. FIG. 8F is a representative isometric view of a preferred embodiment of a valve post 810 of a valve sub-assembly 800 of a cleaning system 100 of the present invention. FIG. 8G is a representative section view of a preferred embodiment of a valve post 810 of a valve sub-assembly 800 of a cleaning system 100 of the present invention. FIG. 8H is a representative detail view of a preferred embodiment of a dip tube 804 and duck bill valve 840 of a valve sub-assembly 800 of a cleaning system 100 of the present invention.

The valve sub-assembly 800 essentially comprises, in a preferred embodiment, a retaining cap portion 802 which fits over the neck 580 of a fluid reservoir Ascending, when in operating position, from the retaining cap portion 802 there is an elongated dip tube 804 with a duck-bill type flow restrictor or valve 806 at the distal end of the dip tube 804.

The outer peripheral edge 822 of the valve cap portion 860 is seated onto an inner flange 824 of the retaining cap portion 802. The valve post 810 is disposed within the central opening 826 through the valve cap portion 860, and the flex dome portion 830 is mounted opposite the valve cap portion 860 with the valve post 810 extending through the assembly 800. In the normally closed position, as shown in FIG. 8C, a first sealing portion 812 of the valve post 810 mates with the upper lip 828 of the central opening 826 and prevents flow through the opening 818 and through the exit port 808.

However, when the valve post 810 is moved upwards as shown by directional indicating arrow C, then the fluid 502 is allowed to flow through opening 818 and through exit port 808. It will be understood that the flex dome portion 830 serves to maintain the valve assembly 800 in a normally closed position, i.e., with the first sealing portion 812 seated firmly against the upper lip 828 of the central opening 826. As the flex dome 830 flexes, the valve post 810 moves axially within the central opening 826 through the valve cap portion 860.

Thus, it will be apparent from the foregoing and the following that as cleaning fluid 502 flows out of the fluid reservoir 500, in order to prevent creating a vacuum in the fluid reservoir 500 while dispensing fluid, thereby interfering with liquid flow by gravity, dip tube 804 which is seated into the side opening 840 allows air to enter the fluid reservoir 500. Air vent opening 842 in flex dome portion 830 provides open communication with the atmosphere through dip tube 804. The duck bill valve 806 or other fluid restrictor means prevents flow of cleaning fluid 502 into the dip tube 804 while at the same time permitting flow of air into the fluid reservoir 500 to replace the volume of cleaning solution or fluid 502 utilized. Thus it will be understood that the system 100 described herein operates by gravity flow of the cleaning fluid through the valve post 810 based upon a pressure head created by remaining fluid in the fluid reservoir 500.

Figure 8I:
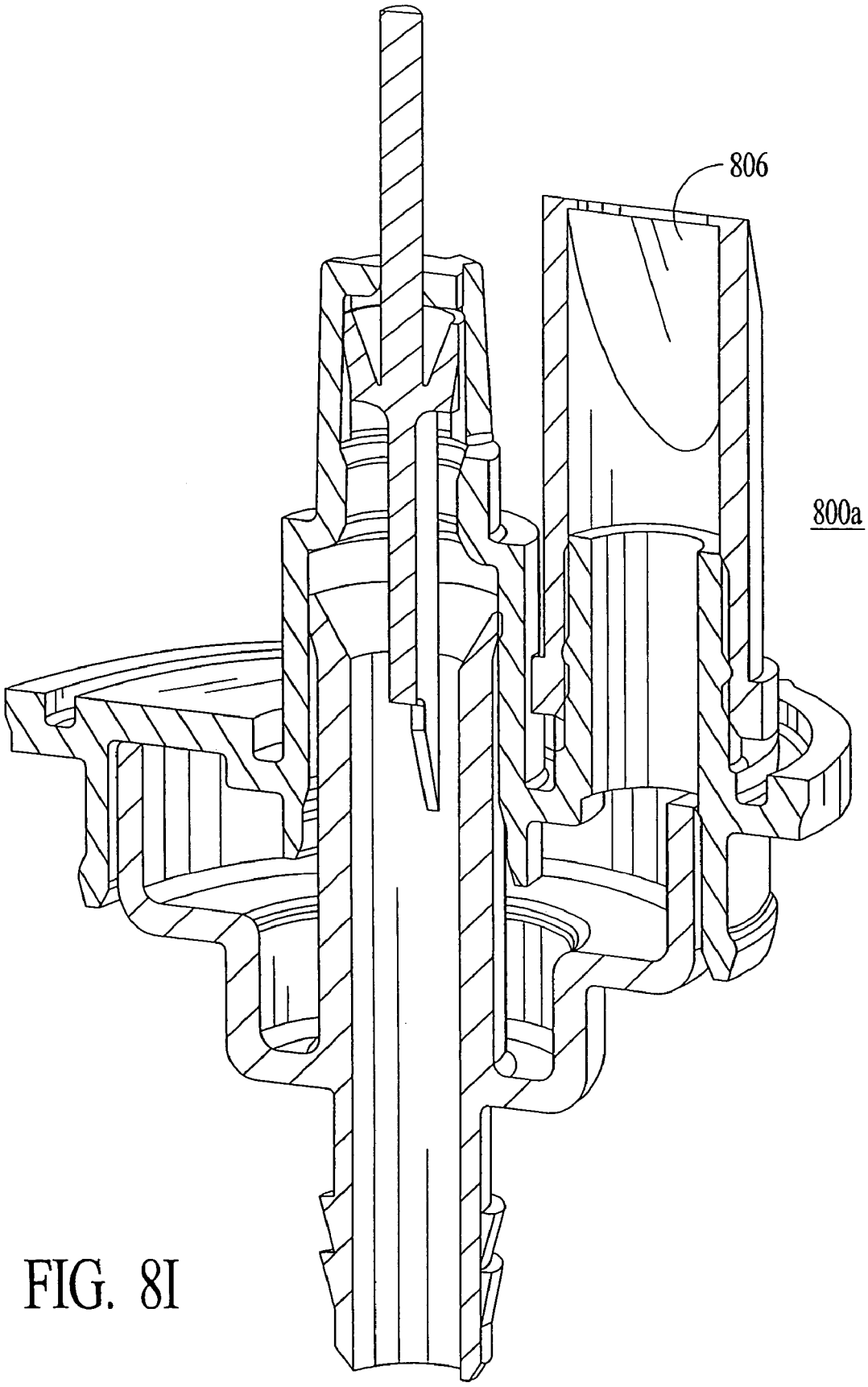
FIG. 8I is a representative isometric view of another preferred embodiment of a valve sub-assembly 800*a* of a cleaning system 100 of the present invention.
Figure 8K:
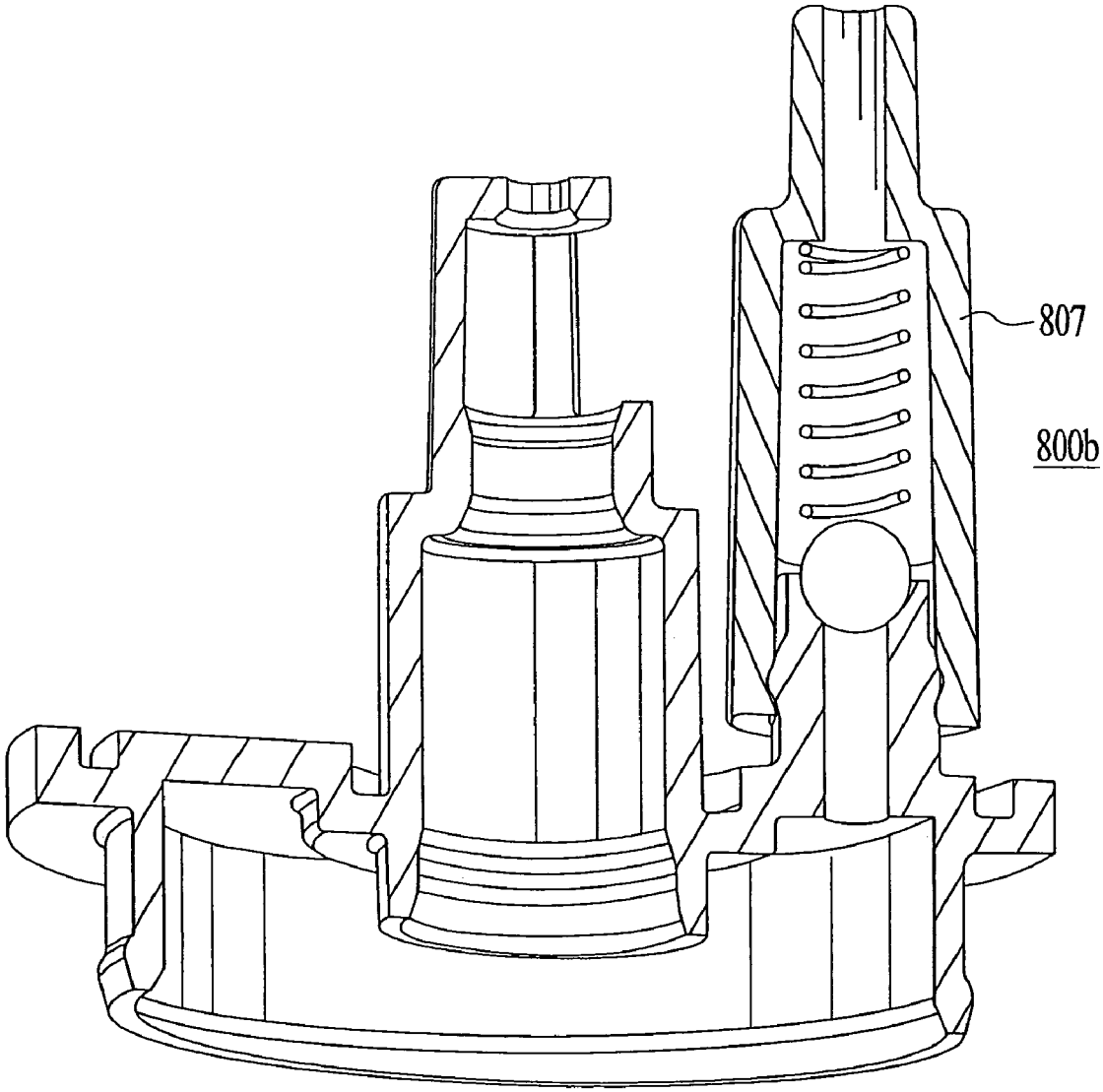
FIG. 8K is a representative isometric section view of yet another preferred embodiment of a valve sub-assembly 800*b* of a cleaning system 100 of the present invention.

FIG. 8I is a representative isometric view of another preferred embodiment of a valve sub-assembly 800*a* of a cleaning system 100 of the present invention. FIG. 8K is a representative isometric section view of yet another preferred embodiment of a valve sub-assembly 800*b* of a cleaning system 100 of the present invention. It will be understood that the valve assembly 800*a* includes the duck bill valve portion 806 without the dip tube portion 804 of the prior embodiments. In yet another preferred embodiment, the valve assembly 800*b* comprises a ball and spring-type check valve 807. It will be understood that other means for venting the fluid reservoir 500 will also be included within the scope of the present invention.

In either case, the duck bill valve 806 or the ball and spring-type check valve 807 or other, as fluid flow trickles out of the system, the volume of the remaining fluid within the fixed-volume reservoir becomes smaller. In order to ventilate the reservoir 500 as the system is in operation, i.e., to maintain essentially atmospheric pressure therewithin as the cleaning fluid 502 flows out of the reservoir 500, once a slightly negative pressure is achieved which is sufficient to overcome the closing force of the valve subassembly 800 or 800*a* or 800*b*, flow of air from the atmosphere flows in a single direction into the reservoir 500, thereby maintaining essentially atmospheric pressure within the reservoir 500 at all times. This system will also provide a uniform flow of cleaning fluid 502 out of the reservoir 500.

Figure 9A:
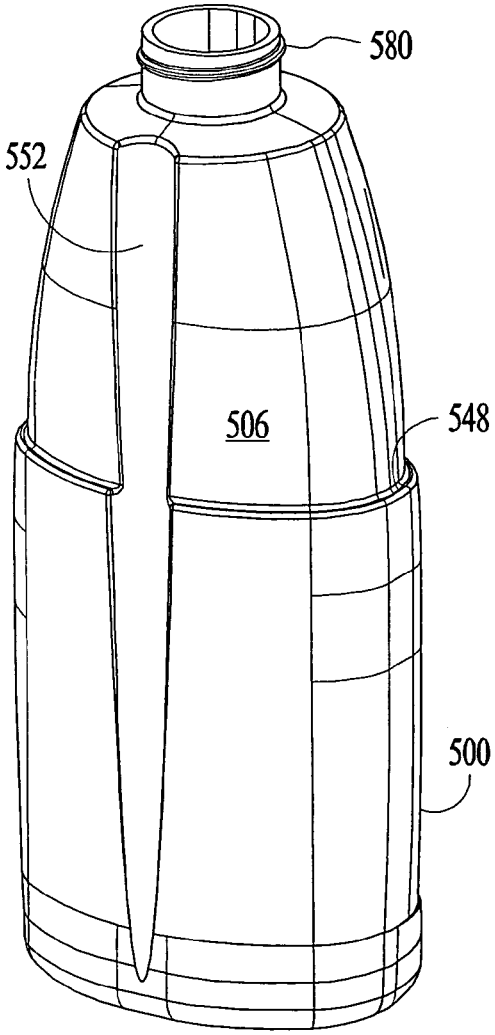
FIG. 9A is a representative upper side view of a preferred embodiment of a cleaning fluid reservoir 500 of a cleaning system 100 of the present invention.
Figure 9B:
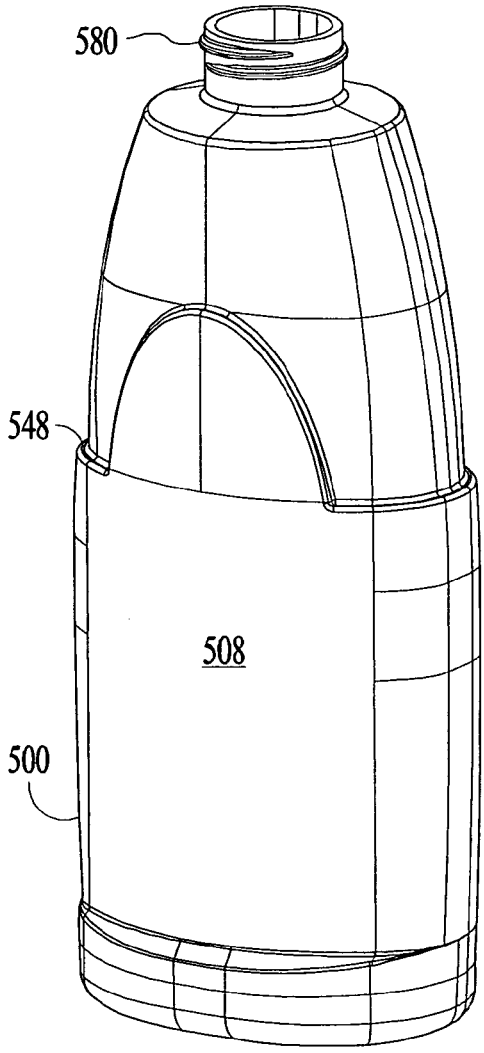
FIG. 9B is a representative lower side view of a preferred embodiment of a cleaning fluid reservoir 500 of a cleaning system 100 of the present invention.

FIG. 9A is a representative upper side view of a preferred embodiment of a cleaning fluid reservoir 500 of a cleaning system 100 of the present invention. FIG. 9B is a representative lower side view of a preferred embodiment of a cleaning fluid reservoir 500 of a cleaning system 100 of the present invention.

It will be understood that the fluid reservoir 500 will contain any desired cleaning fluid or solution 502, including water, etc. In the event that the fluid reservoir 500 is not used with the system 100, in the example of spare or inventories of cleaning fluid reservoirs 500, the reservoirs 500 can be closed using a standard or custom closure cap.

It will be understood by those skilled in the art, based upon the foregoing and upon the following, that the liquid cleaner 502 in the fluid reservoir 500 is essentially water, optionally with low levels of active and/or inactive ingredients. Such cleaning fluid system 502 will be comprised of surfactants and/or solvents, perhaps combined with a water soluble polymer, such as polyacrylate, which actually acts like a clear floor wax. Other cleaning enhancers, floor polishes, anti-streaking agents, fragrances, etc. may be useful in such system 502.

In a preferred embodiment, the cleaning solution provides a no-rinse, single layer, one-step method for cleaning and polishing surfaces including walls, floors, ceilings, leaving a streak-free, non-tacky, clean surface non-attractive to dirt, soils, debris, etc. The device of the present invention ca be used with a single, apply and wipe off solution that cleans without the need to rinse, and which leaves a shine and is not tacky or sticky. In a preferred embodiment, the cleaning fluid 502 comprises a sanitization fluid which serves to sanitize the surface being cleaned, coated or otherwise covered. In preferred embodiments, the cleaning fluid 502 comprises de-odorizing and/or odorizing components.

The advanced cleaning system of the present invention 100 will be particularly suited for cleaning, polishing, or applying a cleaning, shining or other fluid to wood, tile, marble, vinyl, floor covering, hard surfaces, asphalt tile, glass terrazzo, slate, rock, metallic, polymeric, composite or other surfaces.

In a preferred embodiment, the valve sub-assembly 800 of a cleaning system 100 of the present invention is designed such that air does not flow through dip tube 804 and across restrictor valve 806 into fluid reservoir 500 until a certain predetermined volume of liquid has been withdrawn from the reservoir. As the cleaning fluid 502 flows through the system and out the nozzle assembly 700, a slight vacuum develops within the empty space above the remaining liquid 502 in the reservoir 500, before air enters the system to fill the vacuum. The valve subassembly 800 becomes a flow control valve for the cleaning fluid 502 by controlling the air flow into the reservoir 500 and/or the cleaning fluid 502 flow out of the reservoir 500. This method of controlling the flow of cleaning fluid through the system 100 will include other means for controlling the flow, including other control valves, manual, battery or electrically driven or actuated pumps, aerosol mechanism, etc., and will be included within the scope of this invention.

In a preferred embodiment, the reservoir means 500 is keyed, as shown, to fit into the holster assembly 600 in a particular way. This permits orientation of the valve assembly 800 in the holster assembly 600 as desired. The key means can also comprise a locking mechanism to retain the reservoir 500 within the holster portion 600. This locking mechanism can be part of the reservoir 500, such as a clamp, clip, groove or slot with mating portion on the handle portion 400 somewhere, or the locking means can be mounted to or otherwise part of the handle portion 400, such as a clamp, spring-loaded clip, or equivalent secured to shaft section 410 or elsewhere on the system. Based on the foregoing, any combination of locking means and/or keying means for the reservoir 500 to the system 100 is included within the scope of the present invention.

Figure 11:
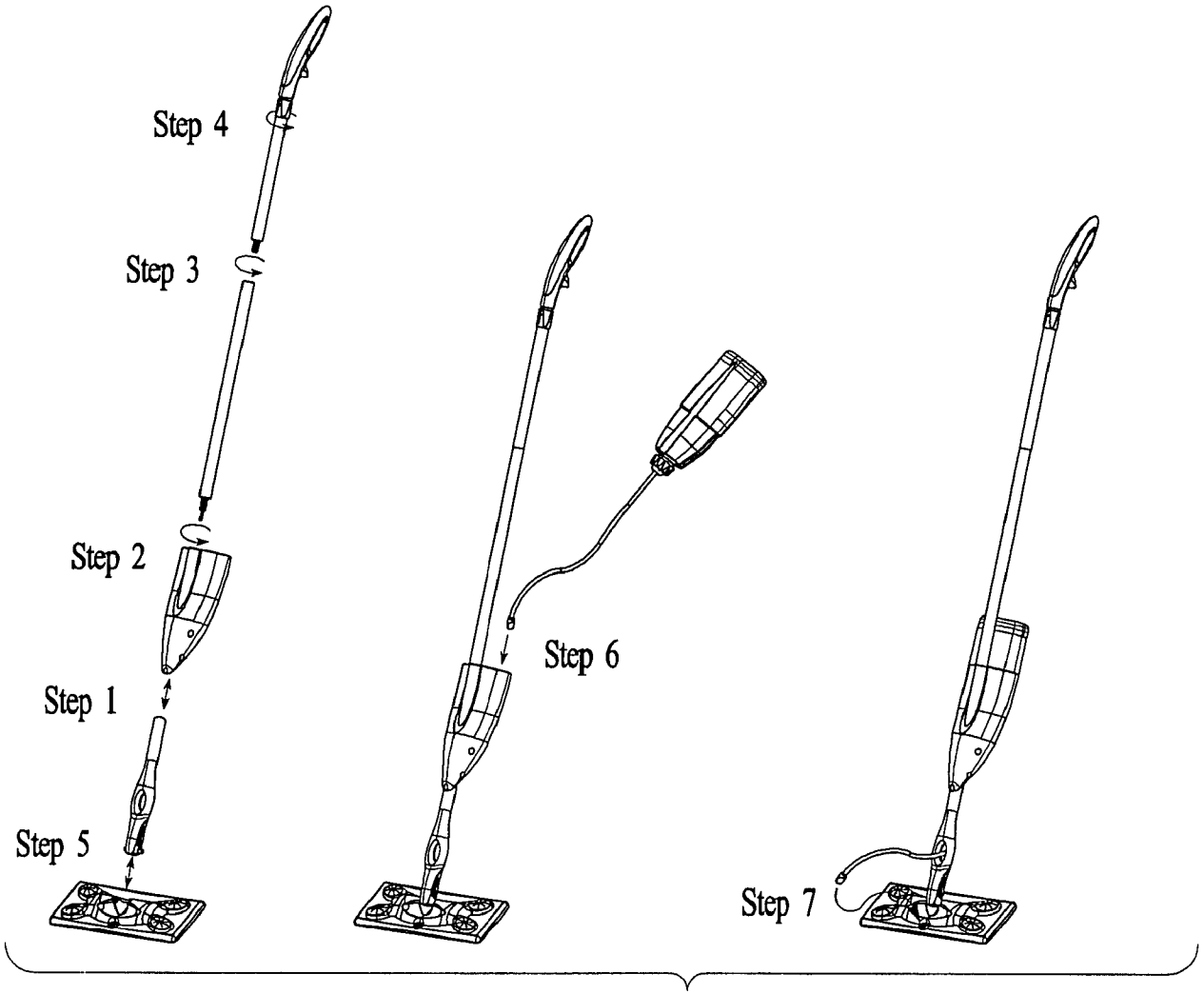
FIG. 11 is a representative schematic view of a preferred embodiment of a method of assembly of a cleaning system 100 of the present invention.

As best shown in FIGS. 1, 6B, 6C, 8A and 9A, the removable coupling means, a system for conveniently coupling and detaching the reservoir, comprises a shaped holster portion with a keyed locking means adapted to receive and lock into place a cleaning fluid reservoir with a correspondingly-shaped mating portion thereon. As shown in FIG. 1 and 11, the reservoir portion 500 seats inside the cradle or holster 600. The removable reservoir 500 has an upper portion 506 having a slightly smaller geometry than its lower portion 508, such that the reservoir location is positioned by stepped portion 548 within the cradle portion 600. The outer edge 554 of the cradle portion 600 firmly seats the reservoir means 500. An external groove 550 located on a peripheral portion of the cradle portion 600 with a correspondingly-shaped mating portion 552 on the reservoir 500 accommodates the elongated shaft section 400*a* or handle 400 at an angle as shown.

In a preferred embodiment, the reservoir 500 has 2 or more compartments, these can be used for containing various chemicals, compounds, cleaners, shining agents, water, etc. If there are 2 chambers, and there is a mixing or common sprayer head, then 2 different liquids can be dispensed, for example, an oxidant bleach in one, a chelating agent in the other (see U.S. Pat. No. 5,767,055 issued Jun. 16, 1998 to Choy, incorporated herein by reference, in its entirety). These can be individually or commonly actuated, with selection means adapted to the specific type of reservoir or multiple-reservoir system used. Multi-chamber reservoirs will also be included within the scope of the present invention.

Figure 10A:
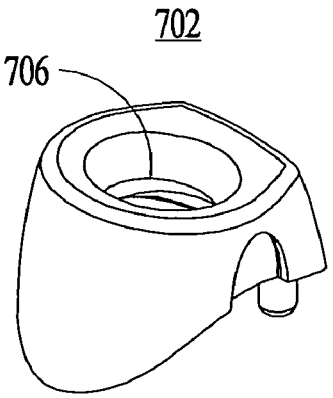
FIG. 10A is a representative upper isometric view of a preferred embodiment of a top portion 702 of a nozzle sub-assembly 700 of a cleaning system 100 of the present invention.
Figure 10B:
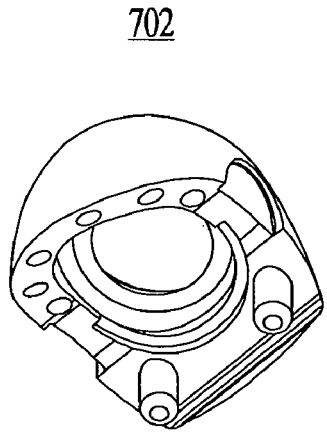
FIG. 10B is a representative lower isometric view of a preferred embodiment of a top portion 702 of a nozzle sub-assembly 700 of a cleaning system 100 of the present invention.
Figure 10C:
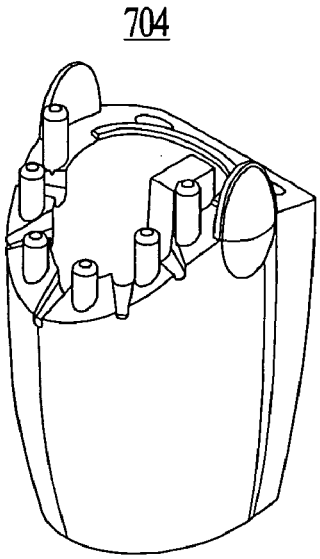
FIG. 10C is a representative upper isometric view of a preferred embodiment of a lower portion 704 of a nozzle sub-assembly 700 of a cleaning system 100 of the present invention.
Figure 10D:
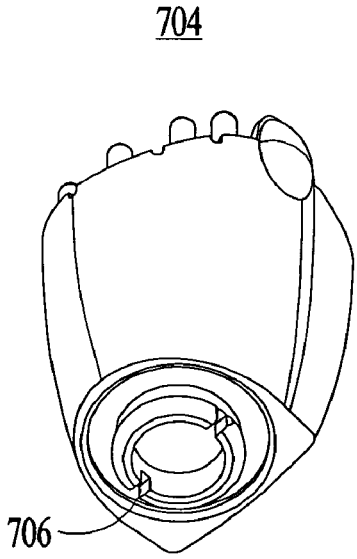
FIG. 10D is a representative lower isometric view of a preferred embodiment of a lower portion 704 of a nozzle sub-assembly 700 of a cleaning system 100 of the present invention.
Figure 10E:
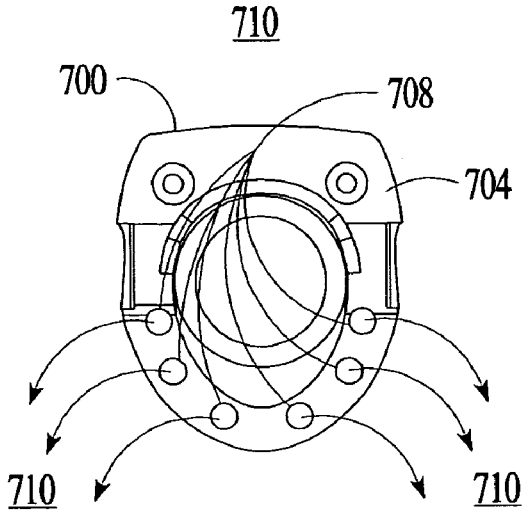
FIG. 10E is a representative top view of a preferred embodiment of a flow pattern 710 of cleaning fluid 502 flowing through the nozzle sub-assembly 700 of a cleaning system 100 of the present invention.
Figure 10F:
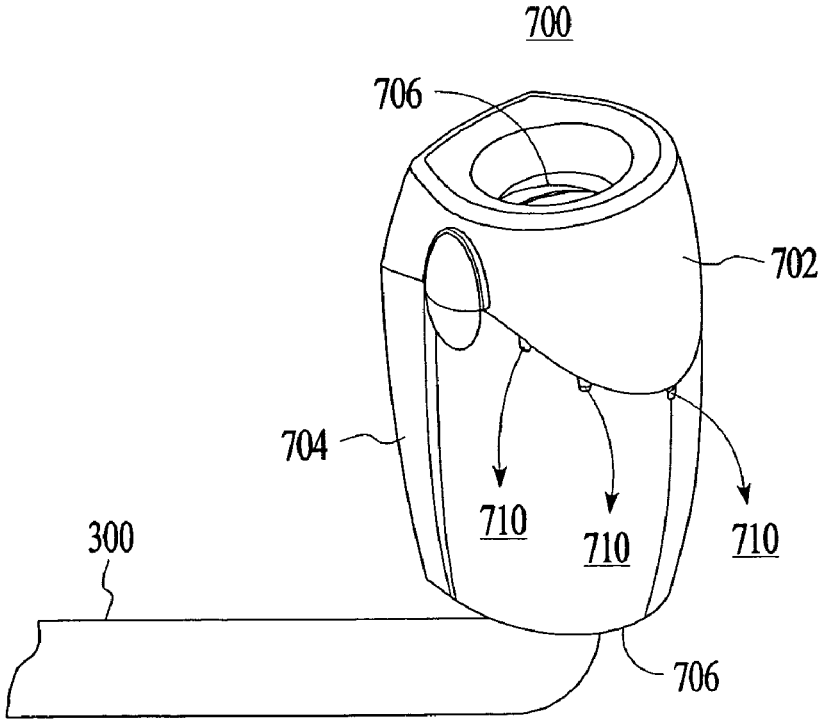
FIG. 10F is a representative perspective view of a preferred embodiment of a flow pattern 710 of cleaning fluid 502 flowing through the nozzle sub-assembly 700 of a cleaning system 100 of the present invention.

FIG. 10A is a representative upper isometric view of a preferred embodiment of a top portion 702 of a nozzle sub-assembly 700 of a cleaning system 100 of the present invention. FIG. 10B is a representative lower isometric view of a preferred embodiment of a top portion 702 of a nozzle sub-assembly 700 of a cleaning system 100 of the present invention. FIG. 10C is a representative upper isometric view of a preferred embodiment of a lower portion 704 of a nozzle sub-assembly 700 of a cleaning system 100 of the present invention. FIG. 10D is a representative lower isometric view of a preferred embodiment of a lower portion 704 of a nozzle sub-assembly 700 of a cleaning system 100 of the present invention.

In a preferred embodiment, ergonomic or high-friction finger grip portions 707 of lower nozzle portion 704 enhance ease of use. It will be understood that these may be material such as rubber or other suitable polymer or other material stubs, appliques or laminates. They could also comprise deformations or protrusions or other formed, shaped or integrated means, as shown.

The snap means 706 or other means for mounting the nozzle 300 to the head assembly 300 can be replaced with any equivalent, including o-ring mounts, snap mounts, screw in, threaded or bayonet mounted, with or without spring-loaded mechanism, as may be most desirable for enhancing utility. A break-away or pop-off, snap-on nozzle assembly 700 will prevent damage to the nozzle assembly 700, the head assembly 300, or to furniture, drapery, etc. Such will also be useful for storage of the system 100.

As described above, manual activation of the finger trigger 402 causes pull rod 440 to be axially moved distally, the linkages between the proximal shaft section 564 and the mid section 400*a* and between the mid section 400*a* and the tubular shaft section 492 of the causing the pull rod 440 to bear distally upon slide 460. As slide 460 is moved distally disposed within the opening 462 of tubular shaft section 492, lever 478 is pivoted so as to bear upwardly against the flex dome portion 830 of the valve sub-assembly 800. As the valve post 810 is un-seated, fluid flows downwardly, by force of gravity, from reservoir 500, through valve post 810, central opening 826 of valve cap 860, flexible delivery tubing 504, and nozzle assembly 700.

It will be understood that in another preferred embodiment, the flex dome portion 830 can be replaced with a spring loaded or other biased, pumping means.

In a preferred embodiment, the seals of the valve post 810 can be enhanced, such as through the use of o-rings, flat seals, cone seals, quad surface and quad ring seals, gland seals, etc.

As described above, the present system is a gravity-fed system, although manually pumped and aerosol or other pressurized delivery systems are included within the scope of the present invention and are claimed herein. As cleaning fluid flows through delivery tube 504, it will emerge from the nozzle assembly 700 as a trickle, cascade, dribble, drip, drizzle, drop, dispersion, seep, spray, stream, sprinkle or other emission having any predetermined or random flow pattern 710. The flow patter 710 may also be varying or modulating. Either one or both of the upper portion 702 and the lower portion 704 of the nozzle assembly 700 has a means 706 for coupling the assembly 700 together, i.e., for coupling a first portion 702 and a second portion 704, as well as for coupling a nozzle assembly 700 to the head sub-assembly 300, including a snap, groove, bayonet mount, mating, helically threaded grooves, hook and loop material (Velcro®) or other attachment mechanism or means. The nozzle 700 could also, in a preferred embodiment, be formed integrally within the head assembly 300, such as comprising one or more unitary molded portions, such that a delivery tube 504 plugs into or otherwise ports directly thereinto.

In a preferred embodiment, the nozzle 700 minimizes vapors, misting, fogging and/or other phase change loss of the cleaning solution during dispensing the fluid 502.

Flow through the orifices 708 of the lower portion 704 or any other portion or portions of the nozzle assembly 700 results in a flow pattern 710 as shown in FIGS. 10E–10F. In a preferred embodiment, the orifices 708 are about 0.5 millimeters in diameter, or more or less, and are directed directly outward, forward, downward, at an angle, to the front, back, side or other, etc.

In a preferred embodiment, the nozzle assembly 700 results in a 5-stream trickle pattern with the following specifications:

| Stream | Azimuth Angle | Elevation Angle |
|---|---|---|
| Single | 0° | −27° |
| Pair | +/−43° | −19° |
| Pair | +/−71.6° | −15° |

Based on the foregoing, it will be understood that within the scope of the present invention, the direction of the flow of cleaning fluid 502 as it emerges from an orifice 708 on the nozzle assembly 700 can vary from an angle between about parallel to the floor, or other surface to be cleaned, to about 30 degrees above parallel, to about 30 degrees below the parallel. In terms of flow pattern of the cleaning fluid 502, the flow can be directed upward, to form an arching trickle or stream, or it can be directed parallel to the surface, or it can be directed somewhat toward the surface to be cleaned.

In a preferred embodiment, the flow of cleaning fluid 502 through the nozzle assembly 700 is optimized to provide an even, uniform distribution, trickle pattern of cleaning fluid 502 in front of the cleaning head assembly 300. The optimum cleaning fluid pattern is a circular area in front of and to the sides in front of the head portion 300. In another preferred trickle distribution pattern, the cleaning fluid 502 is dispensed evenly, in a straight line, essentially in front of the cleaning head portion 300. Flow of cleaning fluid 502 is adequate through all of the orifices 708, rather than being insufficient at the sides. This embodiment is an improvement over systems in which trickle of fluid at the side portions might be slightly less or event totally insufficient, whereas the flow in the center of the nozzle is adequate, due to greater pressure drop through the outside orifices.

FIG. 10E is a representative top view of a preferred embodiment of a flow pattern 710 of cleaning fluid 502 flowing through the nozzle sub-assembly 700 of a cleaning system 100 of the present invention. FIG. 10F is a representative perspective view of a preferred embodiment of a flow pattern 710 of cleaning fluid 502 flowing through the nozzle sub-assembly 700 of a cleaning system 100 of the present invention.

As viewed from above, as shown in FIG. 10E, the flow pattern 710 is outwardly diverging. As viewed from the side in a cross section view, the flow pattern 710 is semi-cone shaped. It will be understood that while fluid may emerge at an angle directed toward or away from or perpendicular to the surface to be cleaned 712, i.e., the floor, the system 100 described herein is primarily a gravity-fed system. In other words, fluid emanating from the nozzle assembly will have an initial direction of flow which may or may not include vertical components, i.e., the fluid directed downward perpendicular to the plane of the floor 712, and would also have some horizontal components, i.e., directed either directly outwardly perpendicular to the surface to be cleaned 712 or directed somewhat toward the surface 712. Furthermore, as a result of the force of gravity acting upon that fluid flow, the flow will develop vertical directional components therein.

Another unique aspect of the present invention is the virtually endless possibility of variations in flow pattern achievable using a nozzle assembly 700 such as shown and described herein. Any known or new and unique variation in nozzle design, including unitary design formed by molding, casting, turning or milling, or any other material additional or removal process, or any multi-section design formed by any of the preceding. Fluid can flow through one or more orifices 708 directed at any angle or angles toward the floor or other surface to be cleaned 712, or at any angle or angles directly perpendicular to the surface 712, or at any angle or angles between 0 and 90 degrees from directly up and away from the floor, although for a floor cleaning system, the latter type would potentially be of less utility.

FIG. 11 is a representative schematic view of a preferred embodiment of a method of assembly of a cleaning system 100 of the present invention. From the foregoing and the following, it will be understood that the cleaning system 100 of the present invention includes and claims to be a fully assembled system and method of use, as well as a system which can be assembled, disassembled, is telescoping or collapsible, or otherwise portable and/or compressible in overall largest dimension.

The present cleaning system 100 invention includes, as described herein, one or more proximal handle assemblies 500, one or more shaft sections 410 of a handle sub-assembly 400, a holster sub-assembly 470 or other similar functional means, a yoke section 450 or similar functional means, a head sub-assembly 300 or similar functional means, and a cleaning fluid reservoir 500 or similar functional means having a fluid delivery tube 504 or similar functional means and a nozzle assembly 700 which mounts onto the head assembly 300 or similar functional means.

In a preferred embodiment, a kit 100 for wet and/or dry cleaning includes one or more proximal handle assemblies 500, one or more shaft sections 410 of a handle sub-assembly 400, a holster sub-assembly 470 or other similar functional means, a yoke section 450 or similar functional means, a head sub-assembly 300 or similar functional means, and a cleaning fluid reservoir 500 or similar functional means having a fluid delivery tube 504 or similar functional means and a nozzle assembly 700 which mounts onto the head assembly 300 or similar functional means.

In a preferred embodiment, the system comprises a reusable handle sub-assembly 400, one or more replaceable cleaning pads 200. Additionally, the handle sub-assembly 400 includes the holster sub-assembly 600. The fluid reservoir 500 can be provided to the user sealed or temporarily closed. Additionally, the nozzle assembly 700, fluid delivery tube 504 and/or valve assembly 800 can be replaceable or non-replaceable, and can be provided with every reservoir 500 cleaning fluid 502 refill, or separately or otherwise.

The method for assembling the kit 100 or cleaning system 100 of the present invention includes the following steps, not intended to be exhaustive, necessary, or all-inclusive and without any other imitations presumed thereby:

- coupling temporarily or permanently one or more shaft sections 410 together;
- coupling temporarily or permanently one or more holster assemblies 600 to the system 100;
- coupling temporarily or permanently one or more yoke sections 450 to the system 100;
- coupling temporarily or permanently one or more head assemblies 300 to the system 100;
- coupling temporarily or permanently one or more proximal handle assemblies 500 to the system 100;
- installing temporarily or permanently one or more fluid reservoirs 500, each having its own associated one or more fluid delivery tubes 504 and one or more nozzle assemblies 700, into the one or more holster assemblies 600;

mounting temporarily or permanently one or more of the nozzle assemblies 700 of the one or more fluid reservoirs 500 onto the one or more of the head assemblies 300;

securing temporarily or permanently one or more cleaning pads 200 or cleaning cloths 200 to the one or more head assemblies 300 with the cleaning pad retaining means 308;

placing the cleaning pad 200 or cleaning cloth 200 onto the surface to be cleaned 712 and moving it back and forth one or more times over a portion of the surface to be cleaned 712;

dispensing an initial volume of cleaning fluid 502 onto the surface to be cleaned 712 and cleaning the surface to be cleaned 712 therewith;

dispensing additional volumes of cleaning fluid 502 onto the surface to be cleaned 712 and repeat cleaning the surface to be cleaned 712;

absorbing dust, dirt, debris, spilled fluids or dispensed cleaning fluid 502 onto the cleaning pad 200 or cloth 200;

replacing temporarily or permanently one or more cleaning pads 200 or cleaning cloths 200 on the one or more head assemblies 300 with the cleaning pad retaining means 308;

replacing temporarily or permanently one or more fluid reservoirs 500 into the one or more holster assemblies 600; and disassembling the wet cleaning kit 100 or cleaning system 100 for transportation, storage, or as desired.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

We claim:

1. A method for use of a gravity-fed cleaning system with replaceable cleaning fluid reservoir, the method comprising the following steps performed in the indicated order:

initially, obtaining a unitary handle portion, the unitary handle portion having:

(1) a proximal portion with a single-handed handle gripping portion and a trigger-style actuator;

(2) a central elongated portion having a removable fluid reservoir housing portion and fluid actuator mechanism; and (3) a distal portion, coupled to the central portion with a rotatable, universal joint swivel mechanism, the distal portion having an essentially rectangular-shaped cleaning head portion with a plurality of mechanical attaching mechanisms located on an outer top portion of the cleaning head portion;

secondly, obtaining a unitary replaceable self-contained fluid path portion, the unitary replaceable fluid path portion having:

(1) a canister-style fluid reservoir portion with sealable connector for sealably coupling to a sealable cap portion;

(2) a sealable cap portion having a sealing portion for sealing to the fluid reservoir portion;

(3) a normally-closed, fluid valve for communicating cleaning fluid therethrough from inside of the fluid reservoir portion to beyond as desired;

(4) a portion of flexible tubing, the tubing having a first end connected to the downstream-end of the fluid valve; and (5) a nozzle with a plurality of orifices, the nozzle coupled to a second end of the portion of flexible tubing;

thirdly, removably installing the fluid reservoir portion of the unitary fluid path portion into the housing portion of the central elongated portion of the unitary handle portion in an inverted position;

fourthly, removably coupling the nozzle portion connected to the flexible tubing portion of the unitary fluid path portion directly to the cleaning head portion of the distal end portion of the unitary handle portion;

fifthly, operating the trigger-style actuator at the proximal end of the unitary handle portion such that cleaning fluid is allowed to flow via gravity from the fluid reservoir portion of the unitary fluid path portion through the valve, flexible tubing and nozzle portions of the unitary fluid path portion in a plurality of individual streams onto the surface to be cleaned in front of the cleaning head portion at the distal end of the unitary handle portion without communication between the cleaning fluid and the unitary handle portion.

* * * * *